US007374483B2

(12) United States Patent
Wiltshire et al.

(10) Patent No.: US 7,374,483 B2
(45) Date of Patent: May 20, 2008

(54) SYSTEM, METHODS AND APPARATUSES FOR LOTTERY POOL MANAGEMENT

(76) Inventors: Richard A. Wiltshire, 1405 Spring Ave., Carrollton, TX (US) 75006; Johnny A. Ortiz, 1129 Heather La., Carrollton, TX (US) 75010; Jean-Philippe Langlois, 5320 Ambergate La., Dallas, TX (US) 75257; Mark E. Aldridge, 1405 Spring Ave., Carrollton, TX (US) 75006

( * ) Notice: Subject to any disclaimer, the term of this patent is extended or adjusted under 35 U.S.C. 154(b) by 1 day.

(21) Appl. No.: 09/803,339

(22) Filed: Mar. 9, 2001

(65) Prior Publication Data

US 2001/0031661 A1 Oct. 18, 2001

Related U.S. Application Data

(60) Provisional application No. 60/188,318, filed on Mar. 10, 2000.

(51) Int. Cl.
*A63F 9/24* (2006.01)

(52) U.S. Cl. ..... 463/17; 463/42

(58) Field of Classification Search ..... 463/40–42, 463/16–20, 25–27

See application file for complete search history.

(56) References Cited

U.S. PATENT DOCUMENTS 5,417,424 A * 5/1995 Snowden et al. ..... 463/18
5,830,063 A * 11/1998 Byrne ..... 463/18
5,910,047 A * 6/1999 Scagnelli et al. ..... 463/17
6,086,477 A * 7/2000 Walker et al. ..... 463/17
6,168,521 B1 * 1/2001 Luciano et al. ..... 463/18
6,251,016 B1 * 6/2001 Tsuda et al. ..... 463/42
6,277,026 B1 * 8/2001 Archer ..... 463/42
6,312,332 B1 * 11/2001 Walker et al. ..... 463/23
6,322,446 B1 * 11/2001 Yacenda ..... 463/16
6,336,862 B1 * 1/2002 Byrne ..... 463/27

OTHER PUBLICATIONS

Texas Lotto Club (www.texaslottoclub.com) © 1997.*
www.archive.org inserting www.texaslottoclub.com into the search archive field.*

* cited by examiner

*Primary Examiner*—Ronald Laneau
*Assistant Examiner*—Travis Banta
(74) *Attorney, Agent, or Firm*—Gardere Wynne Sewell, LLP; Karl L. Larson

(57) ABSTRACT

The present invention provides for a lottery pooling management system. The lottery pooling management system may include a participant interface, lottery interface, and notification interface. The participant interface may be in communication with a participant computer and configured to allow pool participants to participate in one or more lottery pools with each lottery pool having one or more sets of lottery numbers. The lottery interface may be in communication with one or more lotteries and the participant interface, and configured to ascertain drawing results and jackpot amounts for the lotteries and compare the drawing results with the sets of lottery numbers in the lottery pools. The notification interface may be in communication with the participant interface and the lottery interface, and configured to alert pool participants about activity in the lotteries, the status of the lottery pools, and the compared drawing results.

23 Claims, 20 Drawing Sheets

*FIG. 18*

LottoFOX: Game Report: Entries - Microsoft Internet Explorer

File Edit View Favorites Tools Help

Address http://beta.lottofox.com/entries.jsp

My LottoFOX : High Rollers : Game Summary (Saturday, Feb 24, 2001) : Detailed Report

Sign Out

Club Entries ( High Rollers )

Game: Saturday, Feb 24, 2001 1800

Results: 9-50-39-17-43-15 1805

Currently displaying regular game data. Display My Second Chance Entries 1835

<< Summary - MyEntries >>

1810 1825 1815 1830 1820

| Member | Numbers | Matches |
|---|---|---|
| mark | 18-20-22-33-45-52 | 0 |
| mark | 11-17-19-25-31-32 | 1 of 6 |
| mark | 6-24-29-36-41-42 | 0 |
| mark | 3-8-13-37-40-47 | 0 |
| mark | 10-25-26-34-46-53 | 0 |
| Mamasita | 1-6-20-23-31-45 | 0 |
| Mamasita | 6-43-44-47-49-54 | 1 of 6 |
| Mamasita | 2-16-17-26-32-36 | 1 of 6 |
| Mamasita | 20-25-33-39-40-50 | 2 of 6 |
| Mamasita | 1-6-13-27-33-52 | 0 |
| jennifer | 11-12-16-17-32-37 | 1 of 6 |

Done

Internet

SYSTEM, METHODS AND APPARATUSES FOR LOTTERY POOL MANAGEMENT

RELATED APPLICATIONS

This patent application claims the benefit of copending prior filed provisional patent application Ser. No. 60/188,318 filed on Mar. 10, 2000.

FIELD OF THE INVENTION

The present invention is related to electronic gaming over networks and, more particularly, to systems, methods and apparatuses for lottery pool management.

BACKGROUND

Government sponsored lotteries have gained awesome popularity throughout the world. Lotteries have evolved from a deep history that touches the very beginnings of North America dating back to King James I of England who, by royal decree, created a lottery in London. The proceeds were to be used to aid the first British colony in America—Jamestown, Va. In 1964, the New Hampshire Legislature created the first legal state lottery in United States History. By 1973, fiscal year sales for all lotteries surpassed $500 million. In 1976, lottery sales surpassed $1 billion for the first time. By 1998, the Multi-State Lottery Association recorded a world-record lottery jackpot of $295.7 million for its Powerball game. In 1999, Maria Grasso of Boston won a lump sum prize of $104 million in "The Big Game," the largest prize ever won by a single individual. By 1999, thirty-seven states and the District of Columbia operated a lottery in the U.S., along with legal lotteries in Canada. More than 100 foreign lotteries exist today and many have operated for centuries. Some countries, like Mexico, France and Japan, for example, have national lotteries. The International Association of State Lotteries lists 63 member nations—one on every continent except Antarctica.

Lotteries have benefited from the employment of technological advances over the last three decades of the $20^{th}$ century. In 1971, the world's first on-line system was deployed in New Jersey. In 1973, the first secure instant ticket system was developed. In 1974, Massachusetts offered the first scratch-off lottery ticket. In 1975, New Jersey introduced a statewide, on-line network of several hundred Clerk Activated Terminals (CATs) implemented by General Instrument. In 1985, "Tri-State Lotto," the first multi-state lottery, linked the state lotteries of Maine, New Hampshire and Vermont. In 1991, the Virginia Lottery awarded the first instant ticket vending machine contract. In 1986, the Illinois Lottery introduced the first instant game with the concept of qualifying "entry" tickets for a grand prize drawing. With the advent of the World Wide Web and the Internet, electronic Internet Websites have recently been created to provide lottery players with news and statistical information related to lotteries.

With regard to lottery gaming techniques, it is becoming popular to enter into lottery pools in order to increase one's chances of winning the lottery. With a lottery pool, individuals generally get several lottery tickets together to create a larger pool of potentially winning numbers for a group. Generally the burden of collecting tickets, tracking names, and distributing photocopies of the tickets is born by an individual in the group. After the drawing, the pool must be checked against the winning pick. This can quickly become quite time consuming as a winning combination may be a match of three, four, five or six numbers (in a pick six lottery for example). Powerball can be even more difficult to manage. Winning combinations can potentially be overlooked because of manual intervention, which may result in millions of dollars in unclaimed winnings every year.

Therefore a need has arisen in the lottery gaming industry for systems, methods, and apparatuses for managing lottery pools, over global communications networks.

SUMMARY OF THE INVENTION

The present invention provides for a lottery pooling management system. The lottery pooling management system may include a participant interface. The participant interface may be in communication with a participant computer. The participant interface may be configured to allow pool participants to participate in one or more lottery pools with each lottery pool having one or more sets of lottery numbers. The lottery pooling management system may also include a lottery interface. The lottery interface may be in communication with one or more lotteries and the participant interface. The lottery interface may be configured to ascertain drawing results and jackpot amounts for the one or more lotteries and to compare the drawing results with one or more sets of lottery numbers in the one or more lottery pools. The lottery pooling management system may further include a notification interface. The notification interface may be in communication with the participant interface and the lottery interface. The notification interface may be configured to alert pool participants about activity in the one or more lotteries, the status of the lottery pool, and the compared drawing results.

The present invention may also include a method of arranging lottery pools via a global communications network. The method may include the steps of creating one or more lottery pools, each exclusive lottery pool being associated with a lottery, entering one or more sets of lottery numbers into the one or more lottery pools, the one or more sets of lottery numbers corresponding to one or more pool participants, retrieving drawing results and jackpot amounts from the lottery, comparing the drawing results with the one or more sets of lottery numbers and notifying the one or more pool participants of the compared drawing results and of any winning sets of numbers with the lottery pool.

The present invention may further include a computer program embodied on a computer readable medium to arrange lottery pools via a global communications network. The computer program may include a code segment to allow the creation of one or more lottery pools, each lottery pool being associated with a lottery, a code segment to receive one or more sets of lottery numbers into the one or more lottery pools, the one or more sets of lottery numbers corresponding to one or more pool participants, a code segment to retrieve drawing results and jackpot amounts from the lottery, a code segment to compare the drawing results with the one or more sets of lottery numbers and a code segment to notify the one or more pool participants of the compared drawing results and of any winning sets of numbers with the lottery pool.

Additionally, the present invention may include a system for lottery pool management over a global communications network. The system may include one or more participant computers. The system may also include one or more lottery pool management servers, the one or more lottery pool management servers being in communication with the one or more participant computers through the global communications network. Further, the system may include a lottery pool management system resident on the one or more lottery pool management servers. The lottery pool management system may include a participant interface, the participant interface being in communication with a participant computer and being configured to allow pool participants to participate in one or more lottery pools with each lottery pool having one or more sets of lottery numbers, a lottery interface, the lottery interface being in communication with one or more lotteries and the participant interface and being configured to ascertain drawing results and jackpot amounts for the one or more lotteries and to compare the drawing results with one or more sets of lottery numbers in the one or more lottery pools, and a notification interface, the notification interface being in communication with the participant interface and the lottery interface and being configured to alert pool participants about activity in the one or more lotteries, the status of the lottery pool, and the compared drawing results.

BRIEF DESCRIPTION OF THE DRAWINGS

For a more complete understanding of the features and advantages of the present invention, reference is now made to the detailed description of the invention along with the accompanying figures in which the corresponding numerals in the different figures refer to the corresponding parts and in which:

FIG. 18 is a screen shot of a detailed report page of the present invention;

DETAILED DESCRIPTION OF EMBODIMENTS OF THE INVENTION

Figure 1:
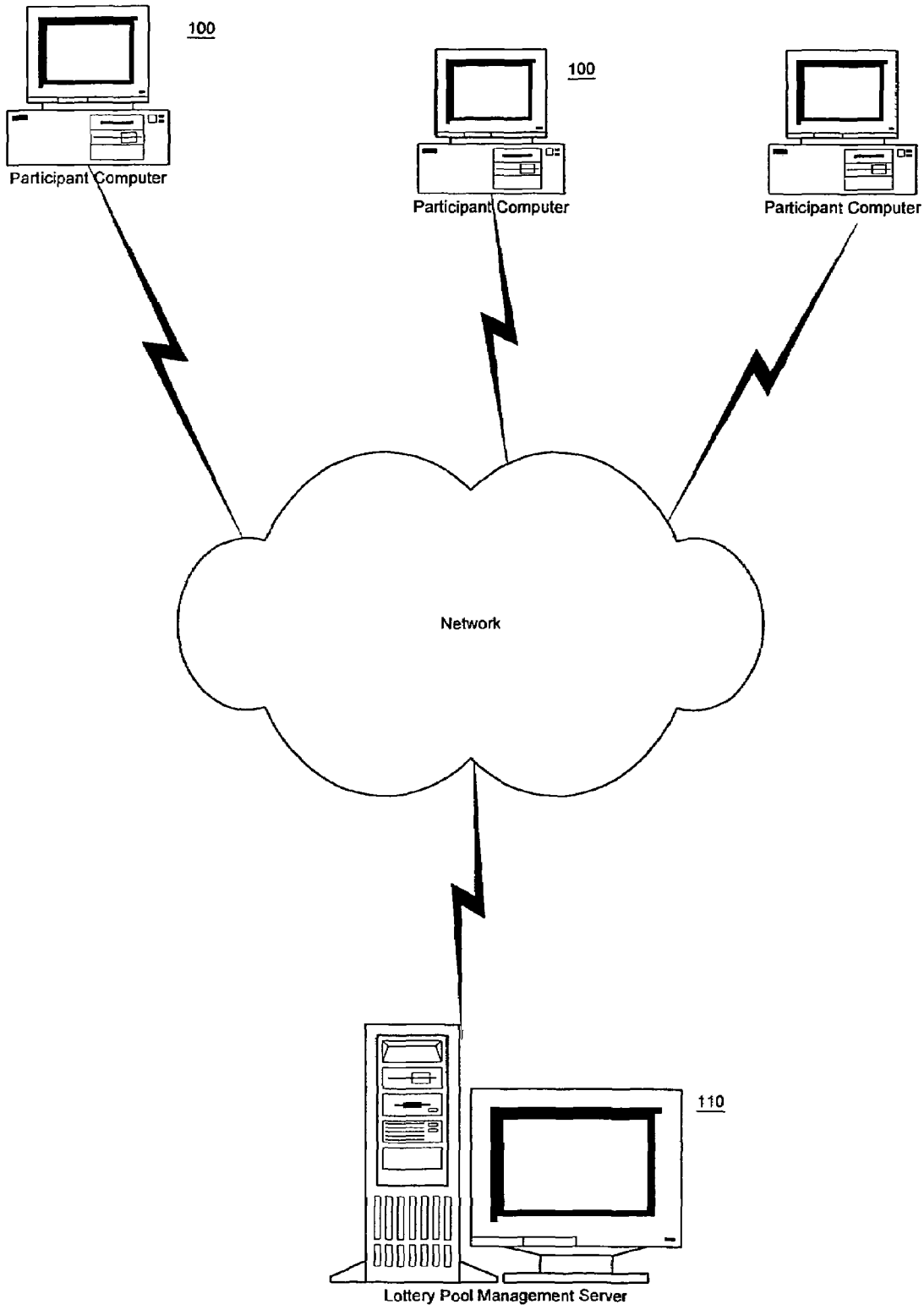
FIG. 1 shows a system for a lottery pool management over a global communications network.

Referring to FIG. 1, a system for lottery pool management over a global communications network is shown. The system includes one or more participant computers 100 in communication with a lottery pool management server 110 through a global communications network 105. The global communications network 105 may be any various communication networks, such as the Internet. The participant computers 100 can be any type of personal computer or work station. The lottery pool management server 110 can be any configuration of network server. Resident on the lottery pool management server 110 can be a lottery pooling management system.

Figure 2:
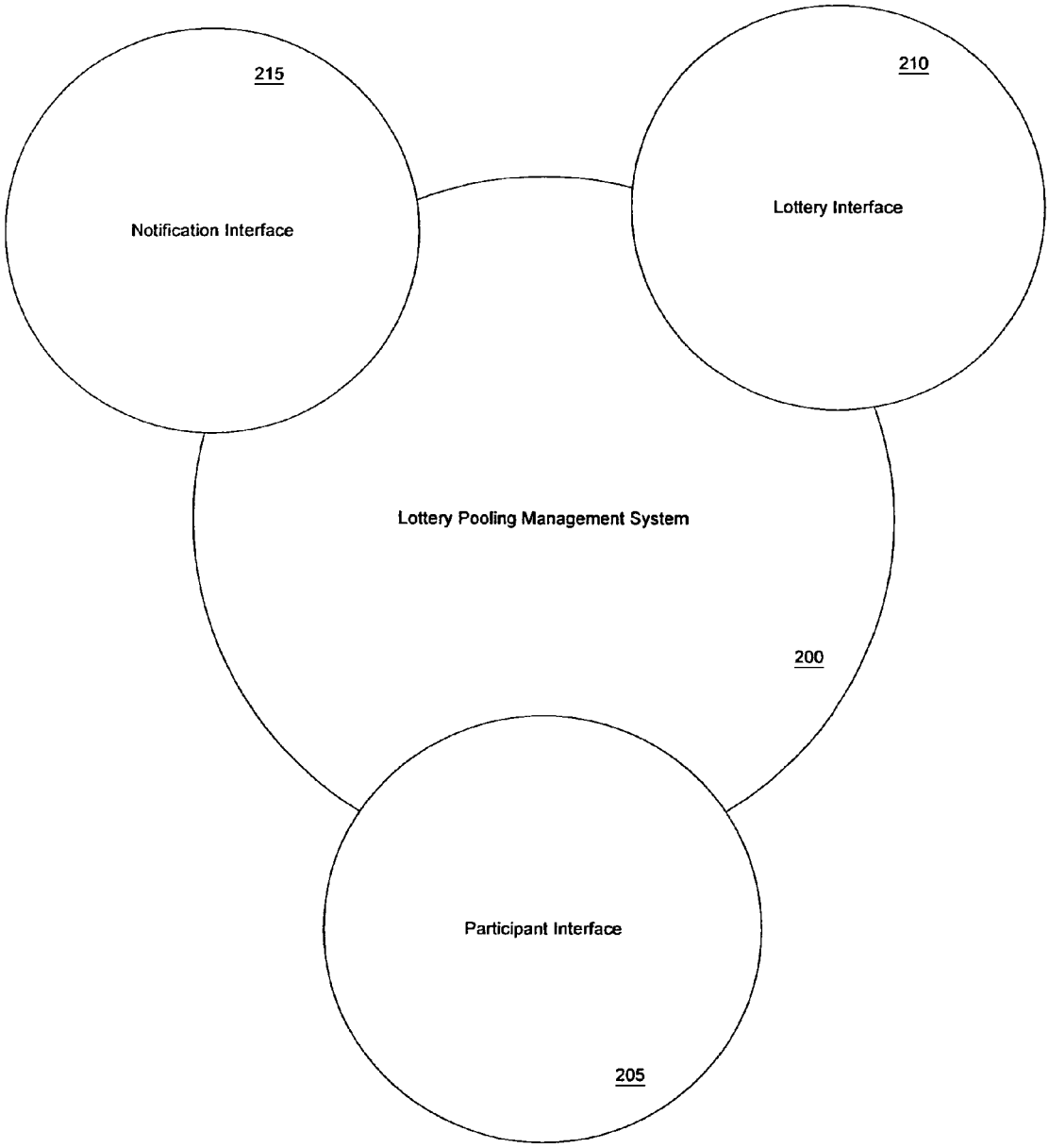
FIG. 2 shows a lottery pooling management system of the present invention.
Figure 3:
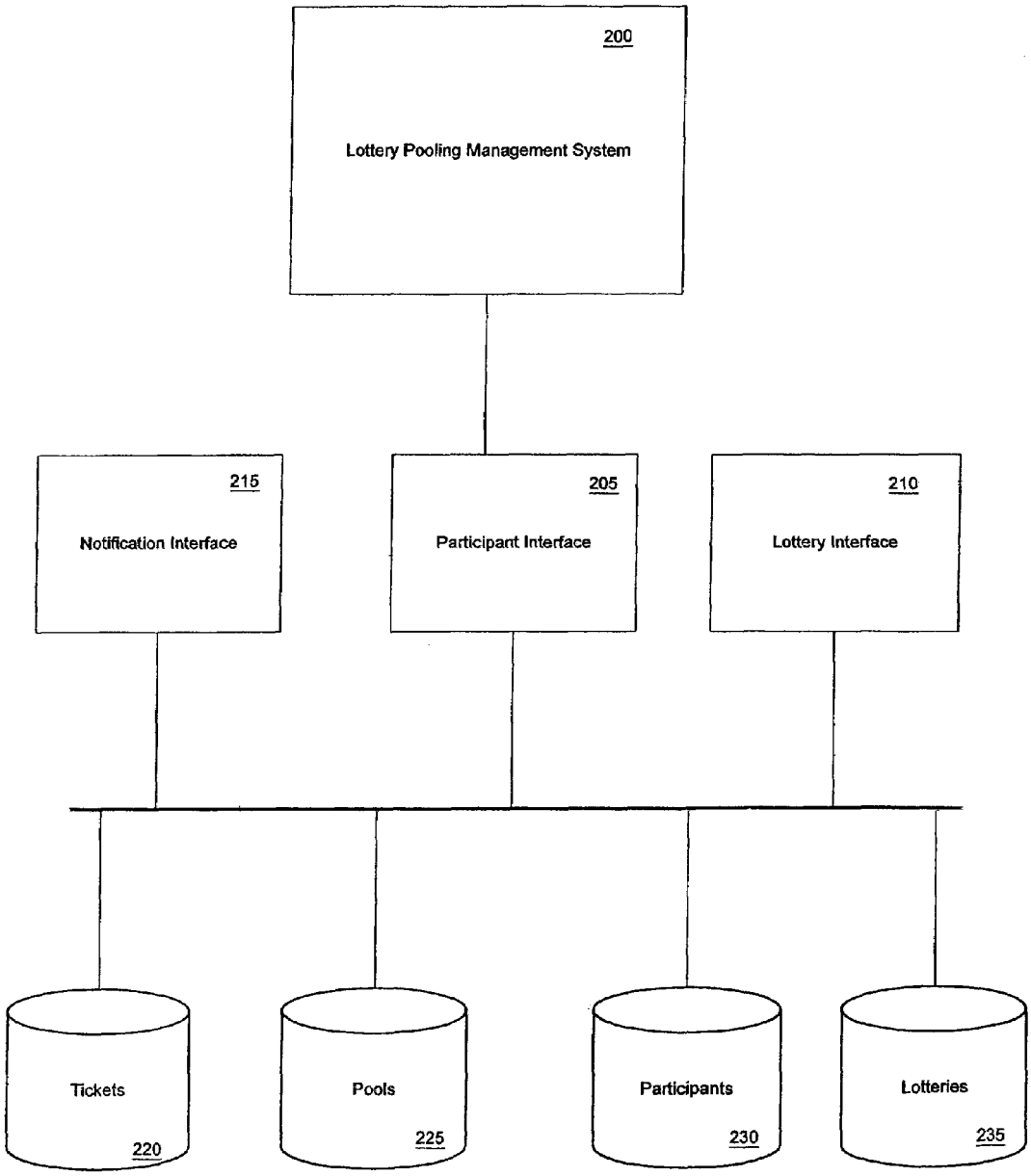
FIG. 3 is another illustration of the lottery pooling management system of the present invention.

Referring now to FIG. 2, the lottery pooling management system resident on the lottery pool management server 110 is generally shown. The lottery pooling management system 200 may include a participant interface 205, a lottery interface 210, and a notification interface 215. The lottery pooling management system 200 may further include one or more databases. As shown by FIG. 3, the one or more databases may include a database for storing information regarding lottery ticket entries 220. The one or more databases may also include a database for storing information regarding various lottery pools 225. In addition, the one or more databases may include a database for storing information concerning pool participants 230. The one or more databases may further include a database for storing information concerning one or more lotteries 235.

Figure 4:
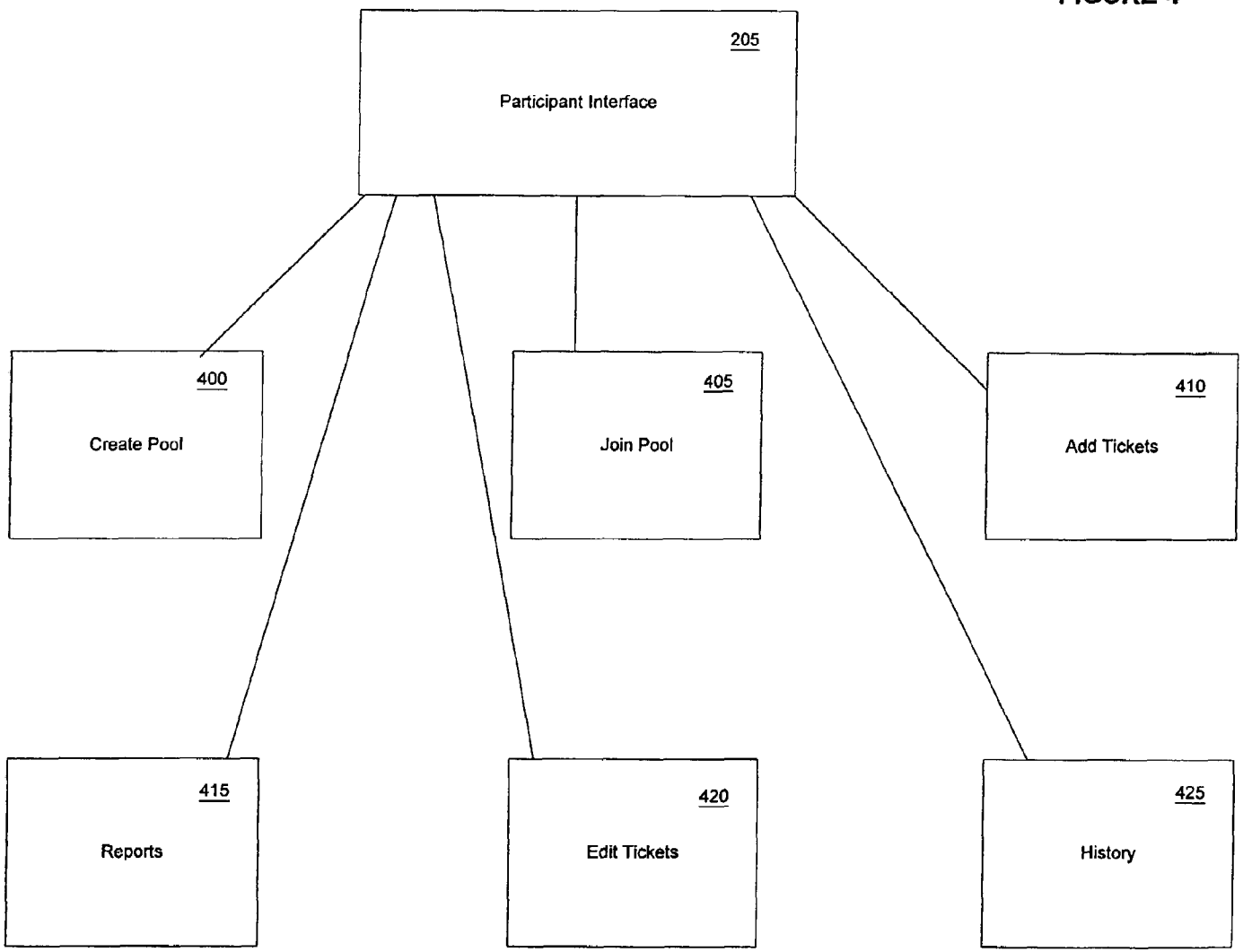
FIG. 4 is a block diagram showing the components of a participant interface of the lottery pooling management system.

Referring now to FIG. 4, the functionality of the participant interface 205 is shown in more detail. The participant interface 205 may include a pool creation module 400. The pool creation module 400 allows pool participants to organize lottery pools. The participant interface 205 may also include a join pool module 405. The join pool module 405 allows pool participants to participate in a lottery pool by selecting entering a login and password for a previously created lottery pool. The participant interface 205 may further include an add ticket module 410. The add ticket module 410 allows pool participants to add lottery ticket numbers to a lottery pool that they have joined. The participant interface 205 may also include a pool reporting module 415. The pool reporting module 415 allows the pool participants to receive information concerning various aspects of their pool, such as the number of tickets entered, the number of winners, and the like. The participant interface 205 may further include an edit ticket module 420. The edit ticket module 420 allows participants to modify their ticket entries within the lottery pool. The participant interface 205 may further include a history module 425. The history module 425 allows pool participants to view prior lottery pools to determine which, if any, combinations of lottery ticket numbers were successful or to determine the percentage of winning for a particular pool or individual pool participant.

Figure 5:
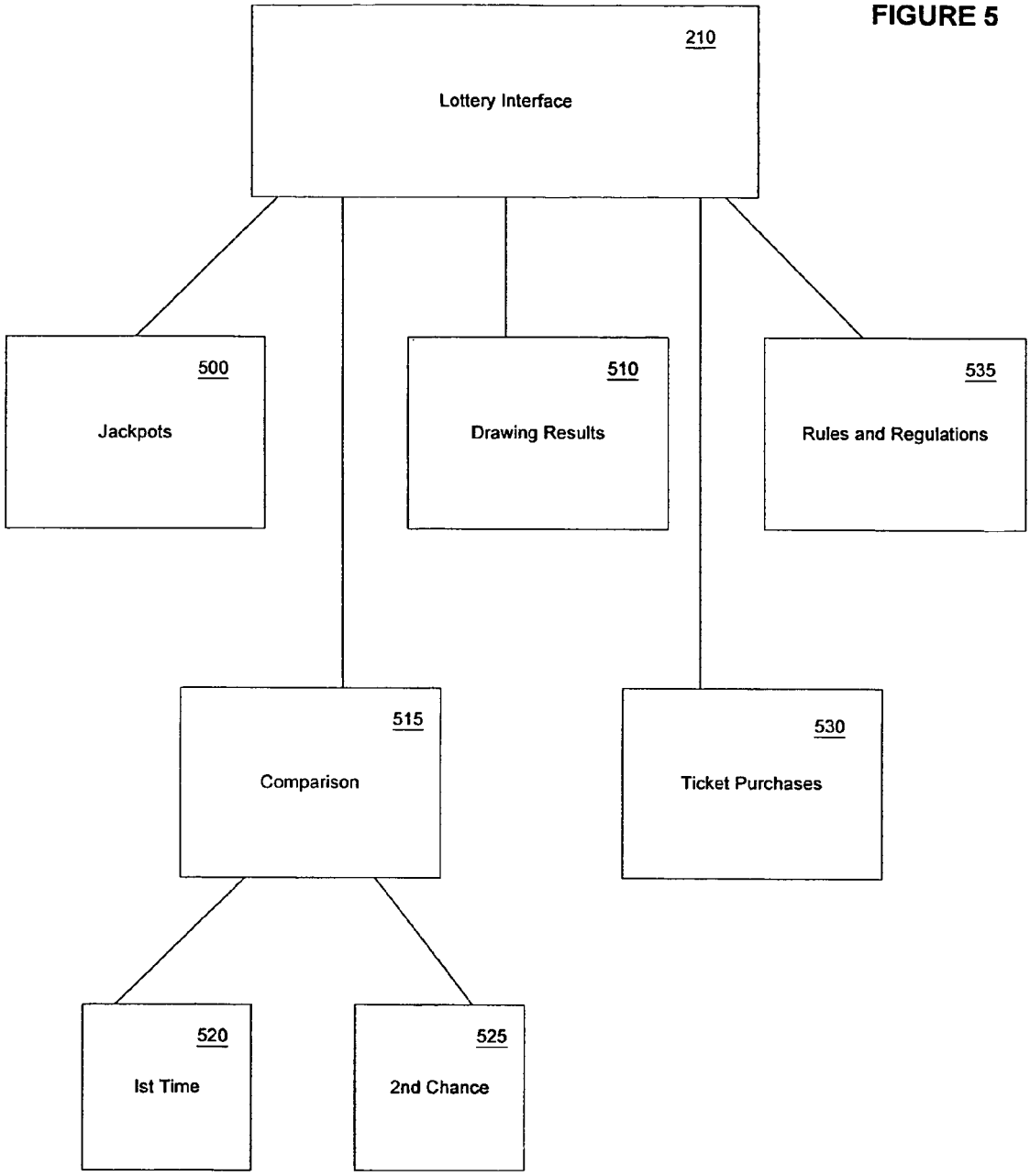
FIG. 5 is a block diagram showing the components of a lottery interface of a lottery pooling management system.

Referring now to FIG. 5, the lottery interface 210 of the lottery pooling management system 205 is shown in more detail. The lottery interface 210 may include a jackpot module 500. The jackpot module 500 allows the lottery interface 210 to retrieve from one or more lotteries the amounts of the jackpots to potentially be awarded by the lotteries during the next drawing. The lottery interface 210 may also include a drawing results module 510. The drawing results module 510 allows the lottery interface 210 to retrieve drawing results from a lottery that has been conducted. The lottery interface 210 may further include a comparison module 515. The comparison module 515 allows lottery interface 210 to compare the retrieved drawing results with one or more sets of lottery numbers entered into each pool by pool participants. The comparison module 515 will compare the drawing results for first time winners 520 and for second chance winners 525. A second chance winner is a pool participant who entered a set of lottery numbers for a lottery drawing and did not win, but has asked the system to lock in and replay that set of numbers for the next drawing of the same lottery. Additionally, the lottery interface 210 may include a ticket purchase module 530. The ticket purchase module 530 enables the lottery interface to purchase tickets through the global communications network for the pool participants. This purchase may be done directly by the pool participant or may be coordinated by the lottery interface 210 through the lottery pooling management system 200. The lottery interface 210 may also include a rules and regulations module 535. The rules and regulations module 535 allows to the lottery interface 210 to retrieve the rules and regulations for each lottery. The lottery interface 210 then establishes guidelines for each lottery pool based upon the rules and regulations of each lottery, including ticket entry guidelines.

Figure 6:
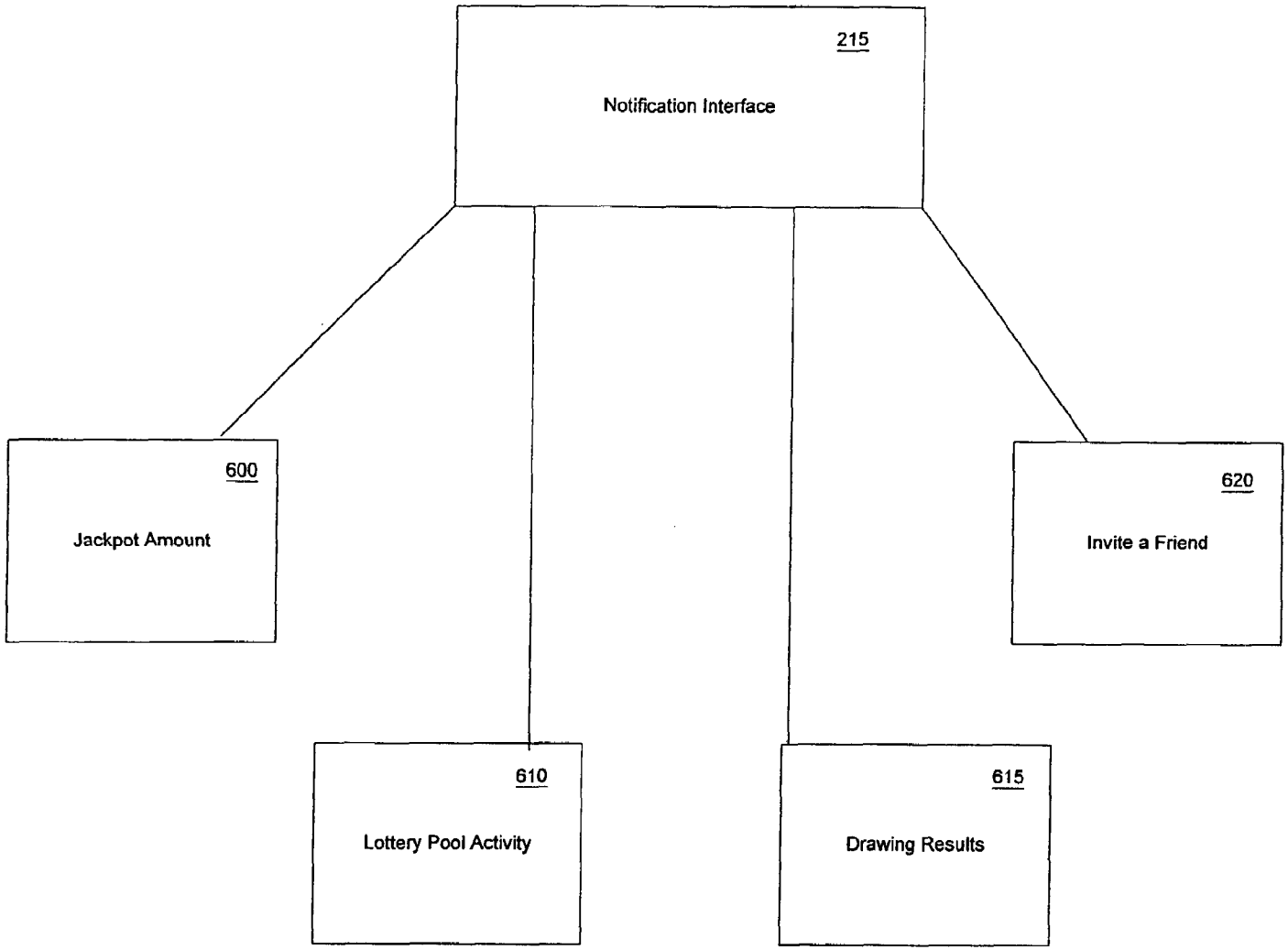
FIG. 6 is block diagram showing the components of a notification interface of the lottery pooling management system.

Referring now to FIG. 6, the notification interface 215 of the lottery pooling management system 200 is shown in more detail. The notification interface 215 may include a jackpot amount module 600. The jackpot amount module 600 allows the notification interface 215 to alert a pool participant or an entire lottery pool when a lottery reaches a certain jackpot level. This level may be specified by the pool participant or pool master. The notification interface 215 may also include a lottery pool activity module 610. The lottery pool activity module allows the notification interface 215 to inform pool participants of any activities within the lottery pool. These activities may include new ticket entries, withdrawal of members, or entrance of new members. The notification interface 215 may further include a drawing results module 615. The drawing results module 615 enables the notification interface 215 to notify the user of the results of a lottery drawing with respect to the lottery pool. The drawing results module 615 of the notification interface 215 coordinates with comparison module 515 of the lottery interface 210. The drawing results module 615 retrieves the first chance comparisons 520 and the second chance comparisons 525 from the comparison module 515 and relays those results to the pool participants through the notification interface 215. Additionally, the notification interface 215 may include an invite a friend module 620. The invite a friend module 620 allows the notification interface 215 to invite others to join a lottery pool as a pool participant.

Figure 7:
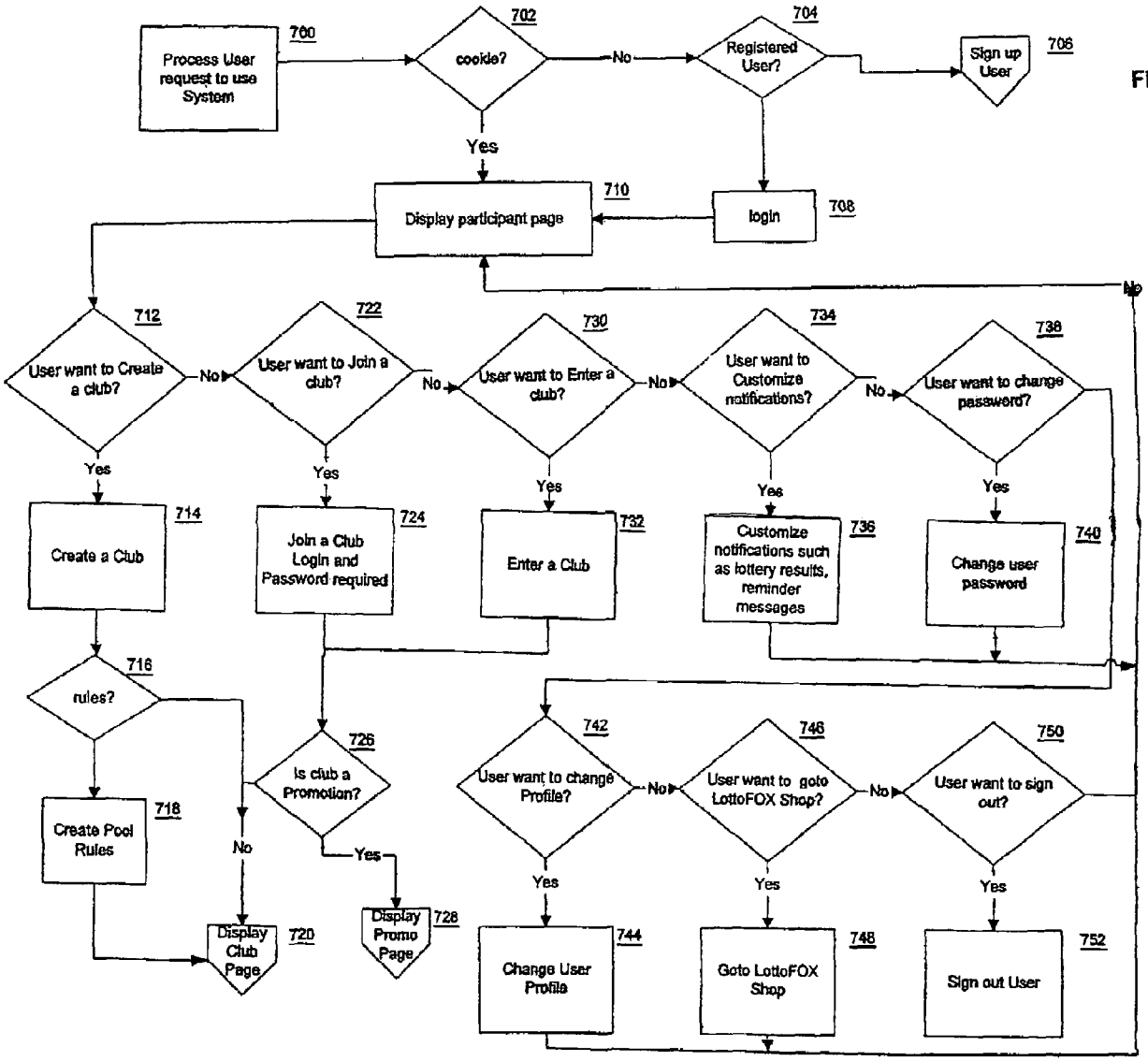
FIG. 7 is a flow diagram of the operation of the lottery pooling management system.

Referring now to FIG. 7, a process flow diagram of the present invention is shown. The process begins by a participant entering the system as in block 700. Once the participant enters the system, the system determines if a cookie has been placed within the participant computer as in block 702. If a cookie has not been placed within the participant computer, then the system determines if the participant is a registered user as in block 704. If the participant is not registered, then the system prompts the participant to sign up as in block 706. If the participant is registered, then the system allows the participant to login to the system by entering the participant's username and password. Once the system has determined that a cookie is present or the participant has logged into the system, the system displays the participant page as in block 710. After the participant page has been displayed, the participant may then use the various features of the system.

The system will first inquire of the participant if the participant desires to create a pool as in block 712. If the participant wishes to create a pool, the system will assist in the creation of the pool by stepping the participant through the process as in block 714. This may include naming the pool, limiting pool access, specifying the lottery associated with the pool, and the like. Once a pool has been created, the system will inquire of the participant whether the participant desires to create rules for the pool as in block 716. If the participant desires to create rules for the pool, then they system will assist the participant in creating the rules as in block 718. The rules may establish the number of participants allowed, the person to whom tickets are to be delivered, the time by which tickets must be received, and the like. If the participant does not desire to create rules, the system will display the pool page for the participant as in block 720. It will be appreciated that once the participant creates a club, the system recognizes the particular participant as the pool master. As the pool master, the participant may at any time create rules governing the pool. Additionally, the pool master will have ultimate control over the pool.

If the participant does not wish to create a pool, the system will then inquire if the participant wishes to join an existing pool as in block 722. If the participant desires to join an existing pool, the system will prompt the participant to enter the login and password for the pool as in block 724. Once the login and password have been entered, the system will determine if the pool is a promotion as in block 726. If the pool is a promotion, the system will display the promotion page as in block 728. If, however, the pool is not a promotion, the system will display the pool page as in block 720.

If the participant does not desire to join an existing pool, the system will inquire as to whether the participant wishes to enter a pool that the participant had previously joined as in block 730. If the participant wishes to enter a previously joined pool, the system will prompt the participant to select the pool to be entered as in block 732. Once the pool has been selected, the system will determine if the pool is a promotion as in block 726. If the pool is a promotion, then the system will display the promotion page as in block 728. If, however, the pool is not a promotion, the system will display the pool page as in block 720.

If the participant does not desire to enter a previously joined pool, then the system determines if the participant desires to customize the notifications given by the system to the participant as in block 734. The notifications may be for new participants in the lottery pool, lottery jackpot amounts, time until the next drawing, and the like. If the participant desires to customize the notifications, the system will display for the participant various customizations from which the participant can select as in block 736. If the participant does not desire to customize the system notifications, then the system will inquire if the participant desires to change the participant's password. If the participant desires to change the participant's password, the system will display a change password screen and allow the participant to enter a new password as in block 740.

If the participant does not desire to change the participant password, then the system inquires whether the participant desires to change the participant profile as in block 742. If the participant desires to change the participant profile, then the system displays a change profile screen 744. If the participant does not desire to change the participant profile, then the system determines whether the participant desires to go to the system's online purchasing center as in block 746.

If the participant desires to go to the online purchasing center, the system will display the online purchasing center for the participant as in block 748. If the participant does not want to enter the online purchasing center, then the system determines if the participant wants to sign out of the system as in block 750. The online purchasing center allows the participant to purchase various items such as T-shirts, cups, mugs, hats, and the like. If the participant wants to sign out of the system, the system will display for the participant the sign out page as in block 752. The sign out page will determine if the participant wants to reenter the system as a new participant or exit the system altogether. If the participant wants to enter the system as a new participant, then the system prompts the participant to enter a new login and password. If the participant desires to exit the system entirely, then the system will return the participant to the participant's homepage.

Figure 8:
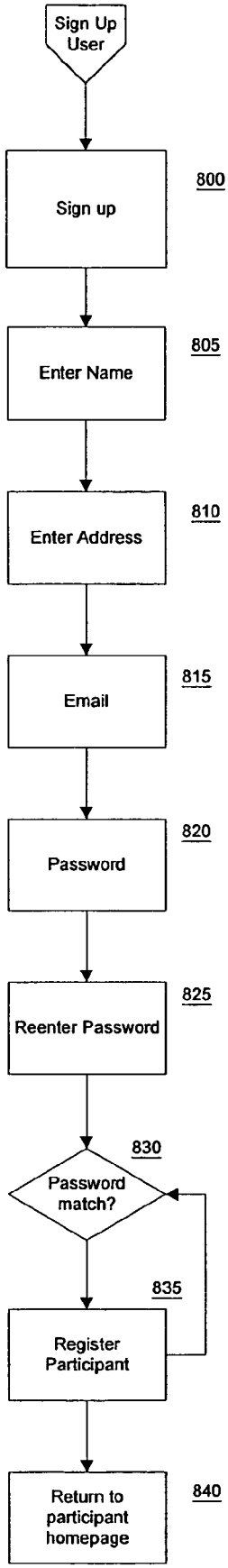
FIG. 8 is a flow diagram showing the new participant sign up process.

Referring now to FIG. 8, a flow diagram showing the participant sign up process is shown. Once a new participant enters the lottery pooling management system and desires to become a member, the system displays for the participant a sign up form as in block 800. The system then requests the participant to enter the participant' name as in block 805. Next, the system prompts the participant to enter the participant's address as in block 810. The system then prompts the participant to enter the participant's email address as in block 815. After the participant has entered the participant's address, the system prompts the participant to select a password as in block 820. Once the participant enters a password, the system directs the participant to reenter the password as in block 825.

After the participant has reentered the password, the system then verifies that the initially entered password and the reentered password are the same as in block 830. If the initially entered password and the reentered password are different, the system will prompt the participant to reenter the initial password as in block 825. If the passwords match, the system will register the participant and create a participant profile within a database in the system using the information provided by the participant as in block 825. The system will then display a participant page for the newly registered participant as in block 710.

Figure 9:
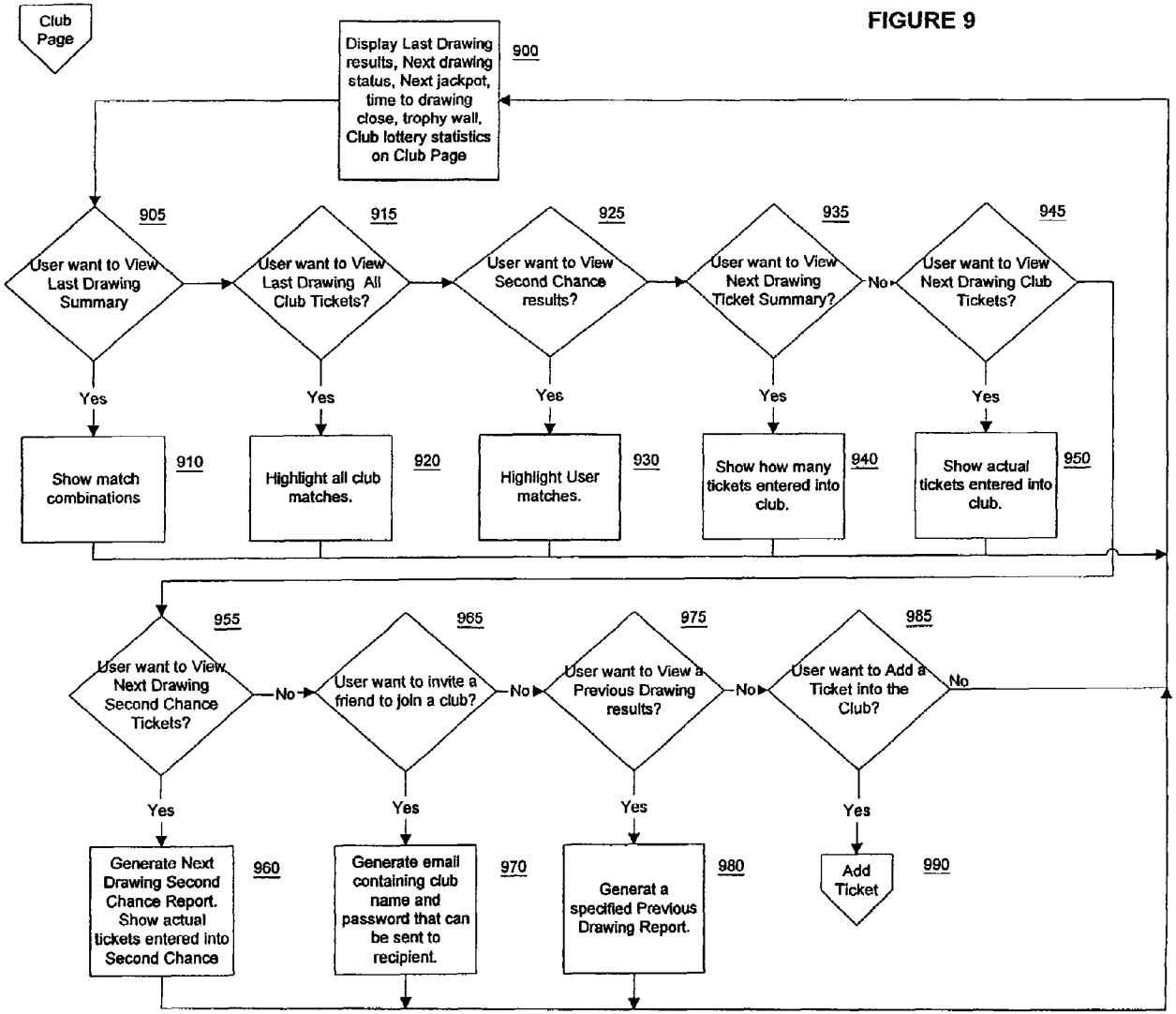
FIG. 9 is a flow diagram showing the operation of a pool page of the lottery pooling management system.

Referring now to FIG. 9, a flow diagram of the operations of the pool page of the lottery pooling management system is shown. Once a participant enters a pool page, the system will display various data concerning the pool as in block 900. The data may include displaying the last drawing results, the status of the next drawing, the status of the next jackpot, the amount of time until the next drawing closes, and the like. An important feature of the pool page is that the pool page displays by not only time, but by color. The pool page will change color to indicate that the next drawing time is becoming closer. This alerts participants about the time remaining for purchasing tickets for a particular lottery.

Once the participant has entered the pool page, the system will inquire as to whether the participant desires to view a summary of the last drawing as in block 905. If the participant wishes to view a summary of the last drawing, then the system will display a summary detailing all the number of matches within the pool. If the participant does not wish to view a summary or last drawing, then the system inquires whether the participant desires to view the actual ticket numbers of the last drawing as in block 915. If the participant desires to view the actual ticket numbers of the last drawing, then the system will prepare and display a report of the ticket numbers and identify all numbers with the one or sets of numbers of the lottery pool that matched the numbers drawn by the lottery as in block 920.

If the participant does not wish to view the tickets of the pool, the system will inquire whether the participant desires to view the participant's second chance results as in block 925. If the participant desires to view the participant's second chance results, then the system will display the one or more sets of ticket numbers played by the participant as second chance tickets and identify the numbers that matched the numbers drawn by the lottery as in block 930. If the participant does not wish to view the participant's second chance results, the system will inquire whether the participant desires to view a summary of the next drawing tickets as in block 935. If the participant desires to view a summary of the next drawing tickets, then the system will display a summary showing the quantity of tickets entered into the pool to present date for the next drawing as in block 940.

If the participant does not wish to view a summary of the next drawing tickets, the system inquires whether the participant desires to view the actual tickets that have been entered into the pool for the next drawing as in block 945. If the participant desires to view the tickets that have been entered into the pool for the next drawing, the system will prepare and display a report of the ticket numbers and the pool participant who entered the ticket numbers as in block 950. If the participant does not wish to view the tickets entered into the pool for the next drawing, then the system inquires whether the participant wishes to view the participant's second chance tickets for the next drawing as in block 955. If the participant wishes to view the second chance tickets for the next drawing, then the system generates a report showing the actual tickets entered and locked into the system as second chance tickets by the participant as in block 960. If the participant does not wish to view the second chance tickets for the next drawing, then the system inquires whether the participant wants to invite a friend to join the pool as in block 965. If the participant wants to invite a friend to join the pool, then they system generates an e-mail page and allows the participant to send a message via the global communications network to the friend as in block 970. It will be appreciated that any other means of electronic network communications may be used in the invite a friend process.

If the participant does not want to invite a friend to joint the pool, then they system inquires whether participant wants to view previous drawing results as in block 975. If the participant wants to view previous drawing results, then the system generates a report displaying the specified previous drawing results as in block 980. The participant can specify the previous drawing results by date or lottery. If the participant does not want to view the previous drawing results, then the system inquires whether the participant wants to add tickets to the pool as in block 985. If the participant wants to add tickets to the pool, the system will then display the add ticket screen for the participant as in block 990. If the participant does not want to add tickets to the pool, the system returns the participant to the main pool page as in block 900.

Figure 10:
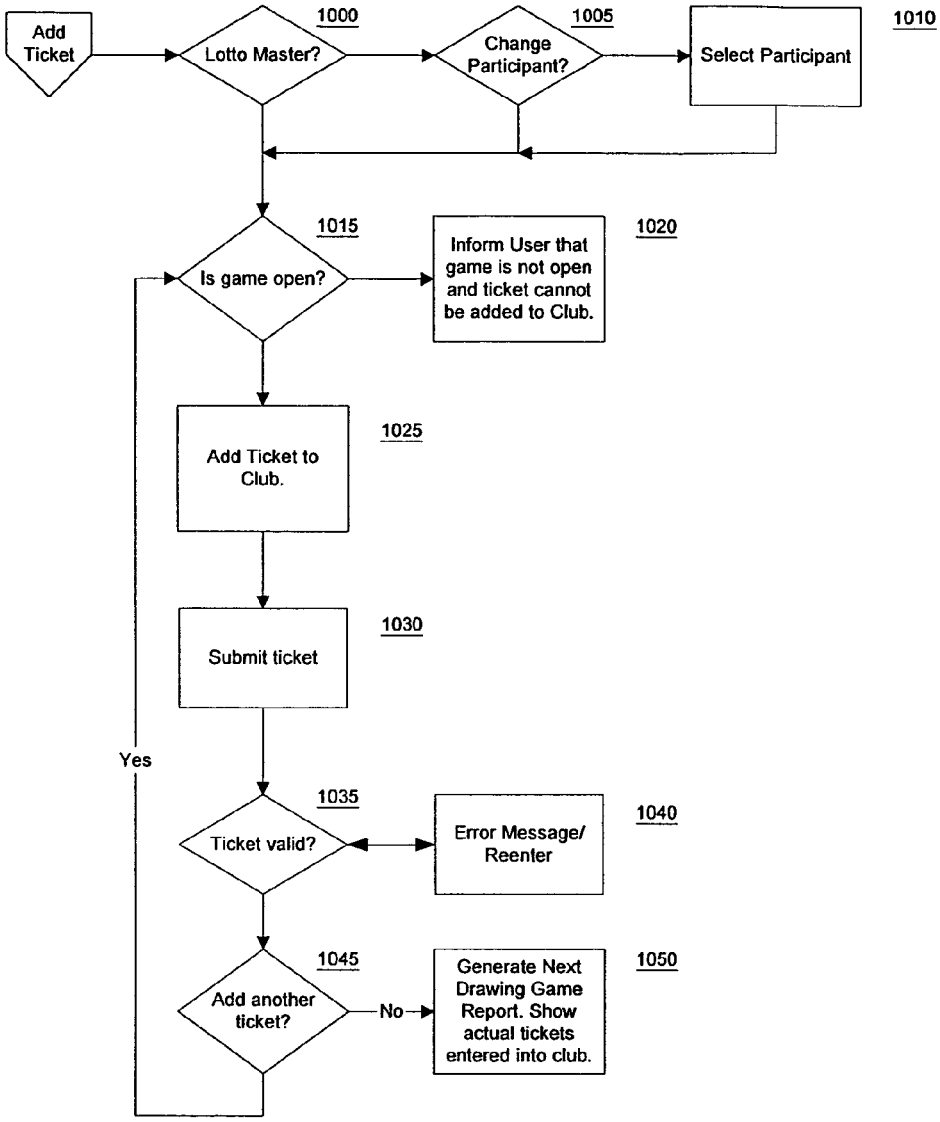
FIG. 10 is a flow diagram showing the add ticket process of the lottery pooling management system.

Referring now to FIG. 10, a flow diagram showing the function of the add ticket mechanism of the lottery pooling management system is given. Once a participant tells the system that the participant wants to add tickets to a pool, the system inquires whether the participant is the pool master as in block 1000. If the participant is the pool master, then the system determines whether the participant wants to enter tickets on behalf of a different pool participant other than the pool master as in block 1005. If the pool master wants to add tickets on behalf of another pool participant, then the system allows the pool master to select the desired pool participant on whose behalf the tickets will be entered as in block 1010. If the system determines that the participant is not the pool master or once the participant has selected another pool participant on whose behalf tickets will be entered, the system then determines whether the particular lottery is still open as in block 1015.

If the particular lottery is closed (usually five minutes before drawing), the system will display a message to the participant alerting the participant that tickets may no longer be added to the pool as in block 1020. If the lottery remains open, the system will then allow the participant to add tickets as in block 1025. The participant may add tickets by filling in the appropriate number in the slots of the add ticket form provided by the system. Once the participant has added the tickets, the system will then prompt the participant to submit the tickets to the system as in block 1030. After the tickets have been submitted to the system, the system verifies that the ticket entries are valid as in block 1035. If the ticket entries are invalid, the system displays an error message and asks the participant to correct the invalid ticket entries as in block 1040. If, however, the ticket entries are valid, the system will inquire whether the participant wants to add more tickets as in block 1045. The validation process performed by the system assures that the ticket numbers entered are valid numbers within the context of the lottery. If the participant wants to add more tickets, then the system will determine whether the lottery is still open as in block 1015. If, however, the participant does not desire to add more tickets, then the system will generate a next drawing game report showing all the tickets entered for the pool as in block 1050.

Figure 11:
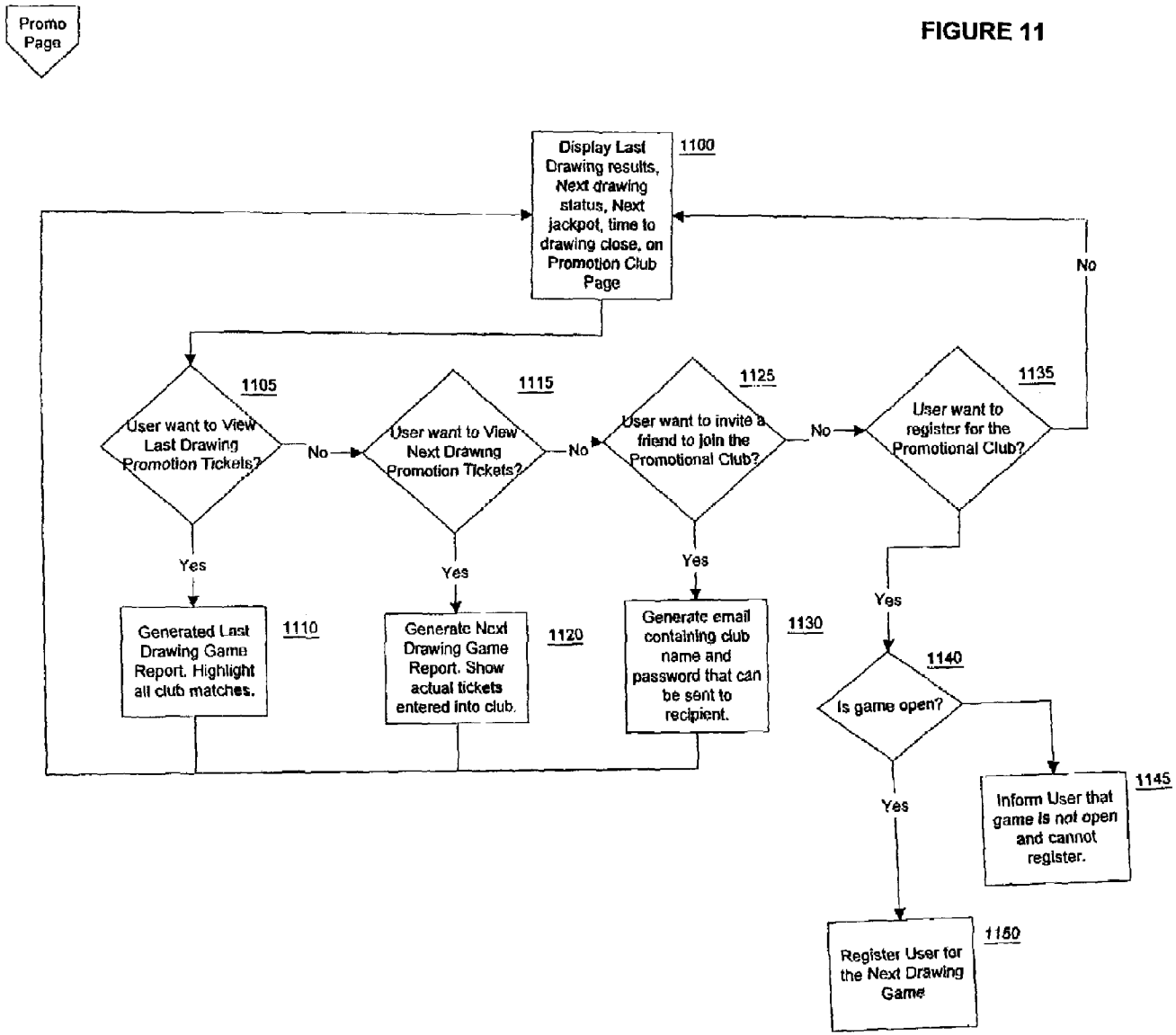
FIG. 11 is a flow diagram showing the operation of the promotions page of the lottery pooling management system.

Referring now to FIG. 11, a flow diagram showing the operation of the promotion page of the lottery pooling management system is given. If a participant joins or enters a pool that is a promotional pool, the system will display the promotional pool page as in block 1100. A promotional pool is a pool sponsored by a third party in which the participants do not enter ticket numbers but are simply participants who share in the winnings. The promotional pool page may contain the last drawing results, the status of the next drawing, the status of the next jackpot, and the like. Once the participant has entered the promotional pool page, the system determines whether the participant wants to view the promotion tickets from the last drawing as in block 1105. If the participant wants to view the promotional tickets from the last drawing, then the system generates a last drawing report showing the tickets and identifying the numbers from the tickets that match the numbers drawn by the lottery as in block 1110. If the participant does not want to view the promotional tickets of the last drawing, the system then inquires whether the participant wants to view the promotional tickets entered in the pool for the next drawing as in block 1115. If the participant wants to view the promotional tickets entered in the pool for the next drawing, then the system will generate a next drawing report showing all the tickets and numbers entered into the pool as in block 1120.

If the participant does not desire to view the promotional tickets for the next drawing, then the system inquires whether the participant wants to invite a friend to join the promotional pool as in block 1125. If the participant wants to invite a friend to join the promotional pool, then the system generates an e-mail page that allows the participant to create an e-mail and send the e-mail to the friend via the global communications network as in block 1130. If the participant does not want to invite a friend to join the promotional pool, then the system inquires whether the participant wants to register for the promotional pool, as in block 1135. If the participant wants to register for the promotional pool, the system will determine whether the lottery is still open as in block 1140. If the lottery is still open, then the system will enter the participant into the promotional pool for the next drawing as in block 1150. If the lottery is closed, then they system will inform the participant that the participant may not enter the promotional pool for the next drawing as in block 1145.

Figure 12:
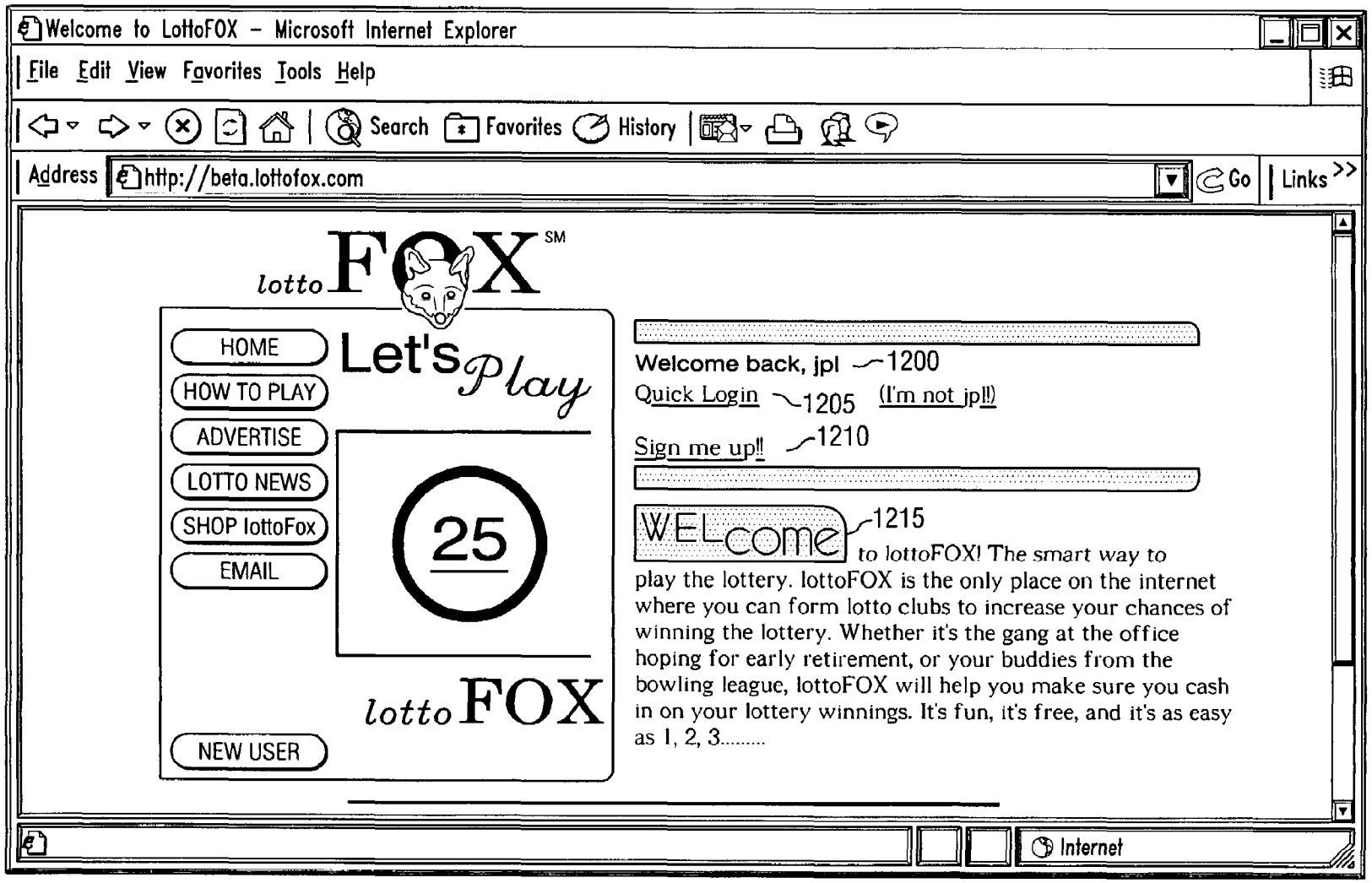
FIG. 12 is a screen shot illustrating the welcome page of the present invention.

FIGS. 12 through 20 demonstrate an example of an embodiment of the lottery pooling management system. Referring now to FIG. 12, a welcome screen for a registered participant is shown. Once a registered participant enters the system, the system determines if the participant's computer has a cookie placed upon it that they system recognizes. If the participant's computer has a cookie placed upon it that the system recognizes, the welcome screen 12 will appear to the participant. The welcome screen may include a greeting 1200. The welcome screen may also include a welcome message 1215. The participant can then either use the quick login link 1205 to enter the lottery pooling management system or a may sign up as a new participant using the sign me up link 1210.

Figure 13:
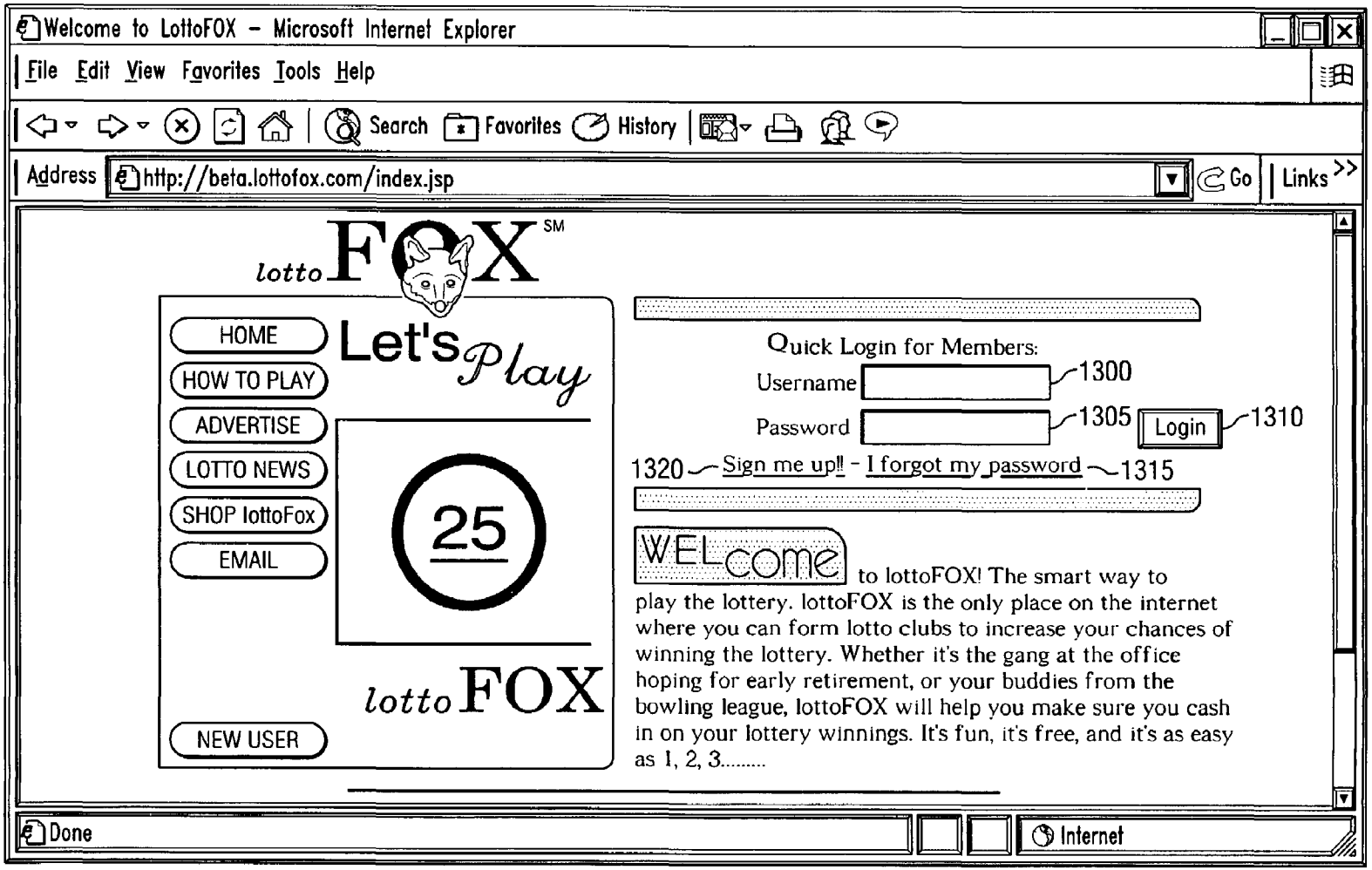
FIG. 13 is a screen shot illustrating another welcome page of the present invention.

Referring now to FIG. 13, a welcome screen is shown for registered participants whose computers do not have a cookie placed on them. The welcome screen allows the registered participants to enter their user name 1300 and password 1305. Once the participants have entered the user name 1300 and password 1305 they may select the login button 1310 to enter the lottery pooling management system. If the participant has forgotten the participant's password, the participant may select the forgot my password link 1315 and the system will remind the participant of the participant's password. The participant may also select the sign up link 1320 to sign up as a new participant in the lottery pooling management system.

Figure 14:
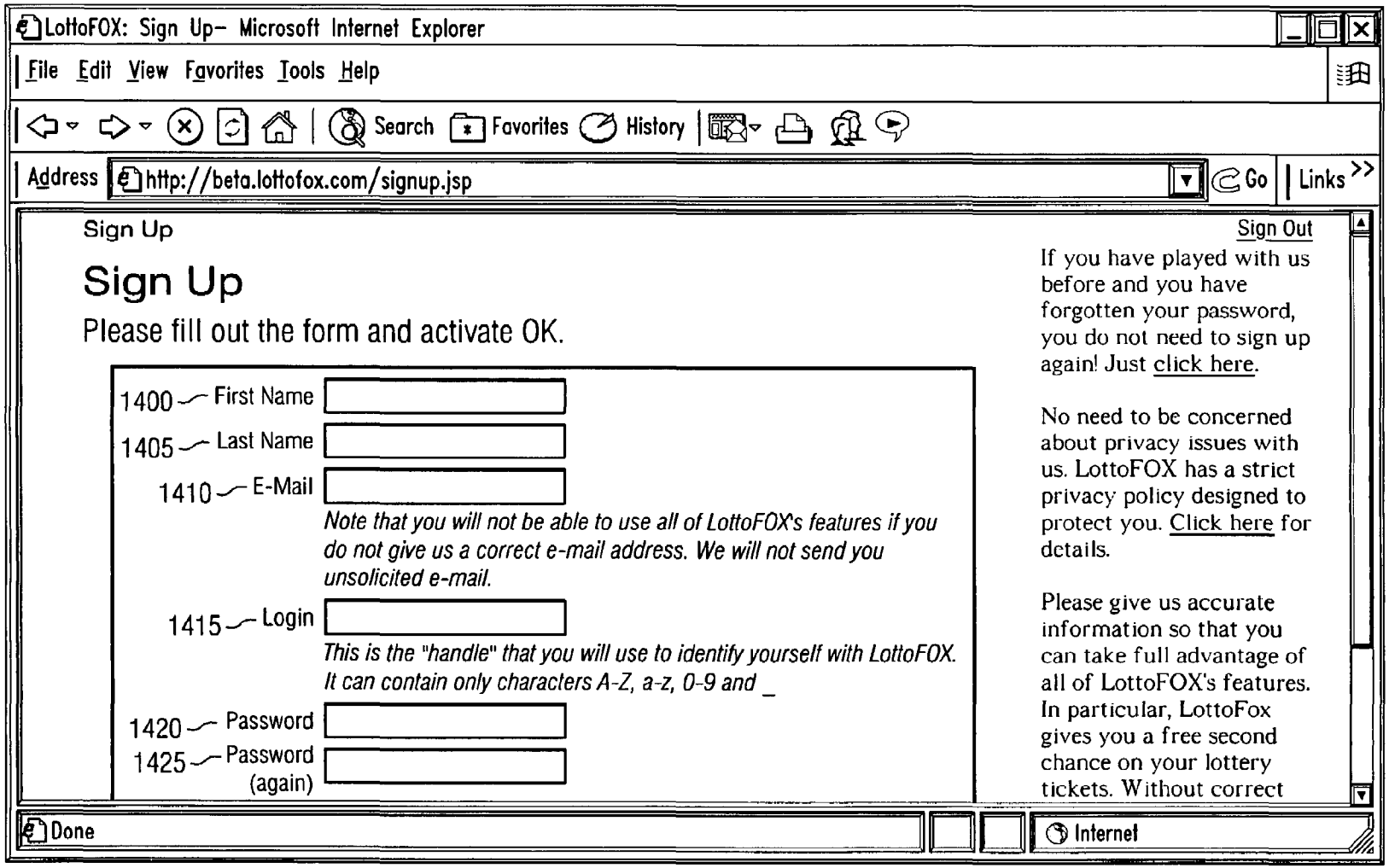
FIG. 14 is a screen shot of a sign up page of the present invention.

If the participant selects a sign up link then the system will display a sign up screen as in FIG. 14. The sign up screen will prompt the user to enter the participant's first name 1400 and the participant's last name 1405. The system will then prompt the participant to enter the participant's e-mail address 1410. The participant may then select a login 1415 to be used as the participant's username. The participant may then select a password 1420. The system will then ask the user to verify the password by reentering the password at 1425.

Figure 15:
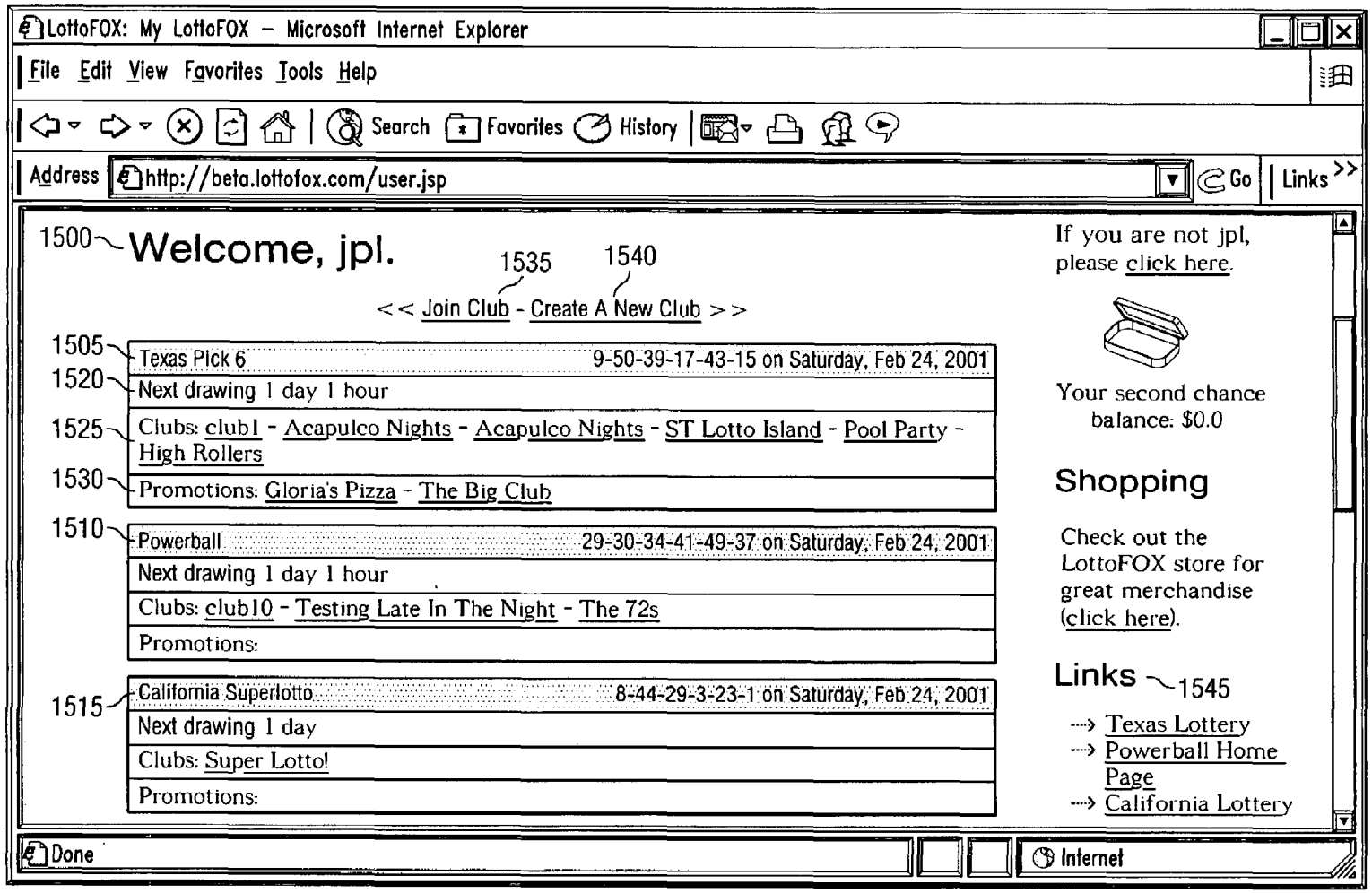
FIG. 15 is a screen shot of a lottery page of the present invention.

Once the participant has entered the lottery pooling management system, the system will display the various lotteries available for pools as in 1505, 1510, and 1515 of FIG. 15. The system may display the name of the lottery, the numbers of the last drawing and the date on which the last drawing occurred. The system may also display the amount of time until the next drawing as in 1520. For each lottery, the system will display the available pools or clubs 1525 available for the participant to join. Also the system will display any promotional pools 1530 available for the participant to join. From this screen, the participant can either join a pool by selecting the join club link 1535 or create a new pool by selecting the new pool link 1540. Additionally, the participant can choose a lottery link 1545 to explore the various lotteries.

Figure 16:
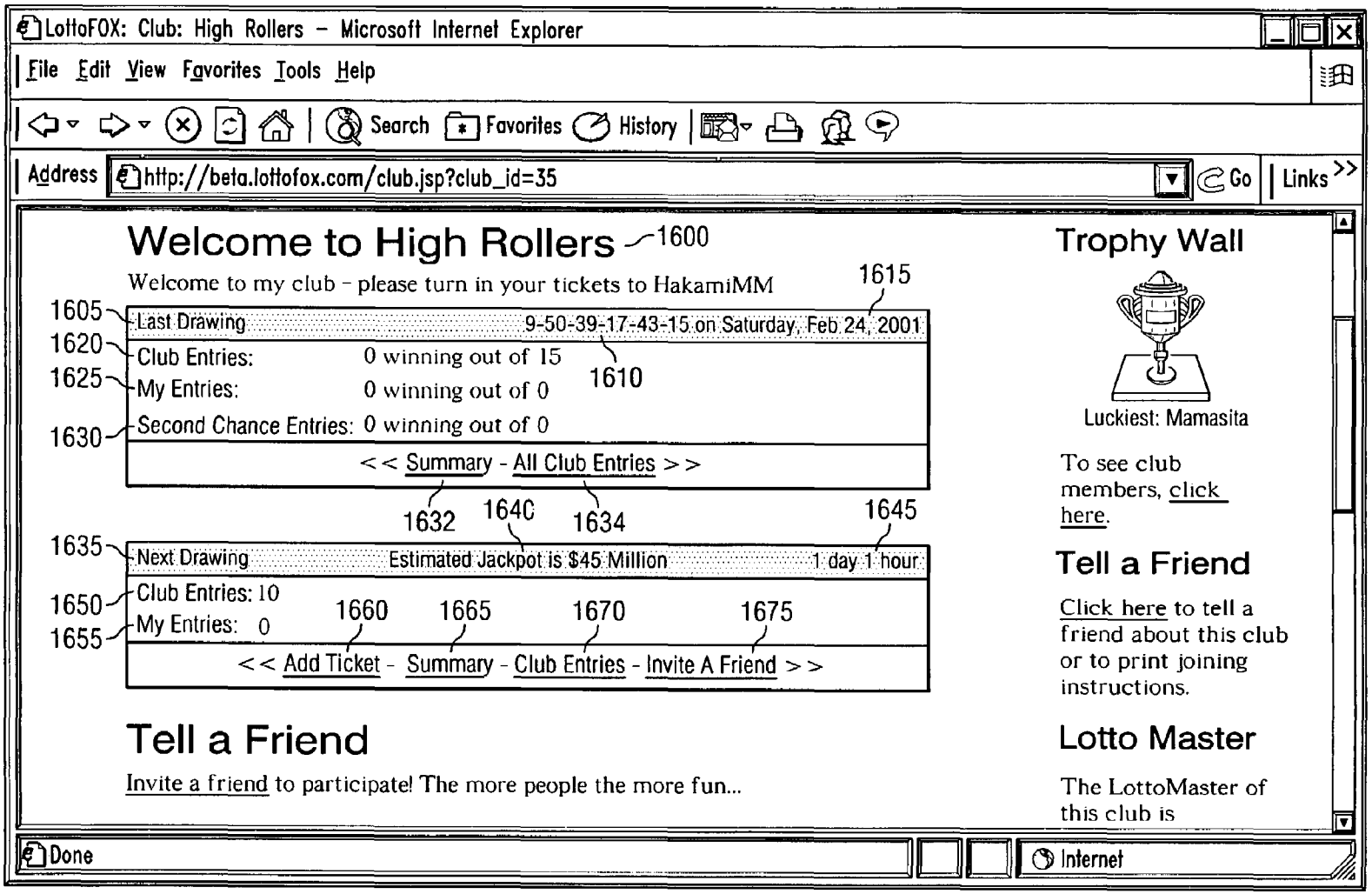
FIG. 16 is a screen shot of a pool page of the present invention.

After a participant has selected a pool to join, the pool page will be displayed as in FIG. 16. The system will display a greeting 1600 telling the participant the pool selected. The system will then display the last drawing of the pool 1605.

This may include the numbers selected during the last drawing 1610 and the date of the last drawing 1615. The system may also display the number of pool entries 1620, the number of entries for the particular participant 1625, and the number of second chance entries 1630. For each of these entries 1620, 1625, and 1630, the system will display the number of winning entries out of the number of total entries.

The participant may select to have a summary of all entries by selecting the summary link 1632 or have details about all the pool entries by selecting the all club entries link 1634. The system will also display the next drawing for the pool 1635. Along with the next drawing, the system will display the estimated jackpot 1640 and the amount of time until the next drawing 1645. The system will display the number of pool entries 1650 for the next drawing and the number of entries for the particular participant 1655. The participant may then choose to add tickets by selecting the add ticket link 1660, choose to have a summary of the pool entries 1665, choose to have a detailed list of the pool entries 1670, or choose to invite a friend 1675.

Figure 17:
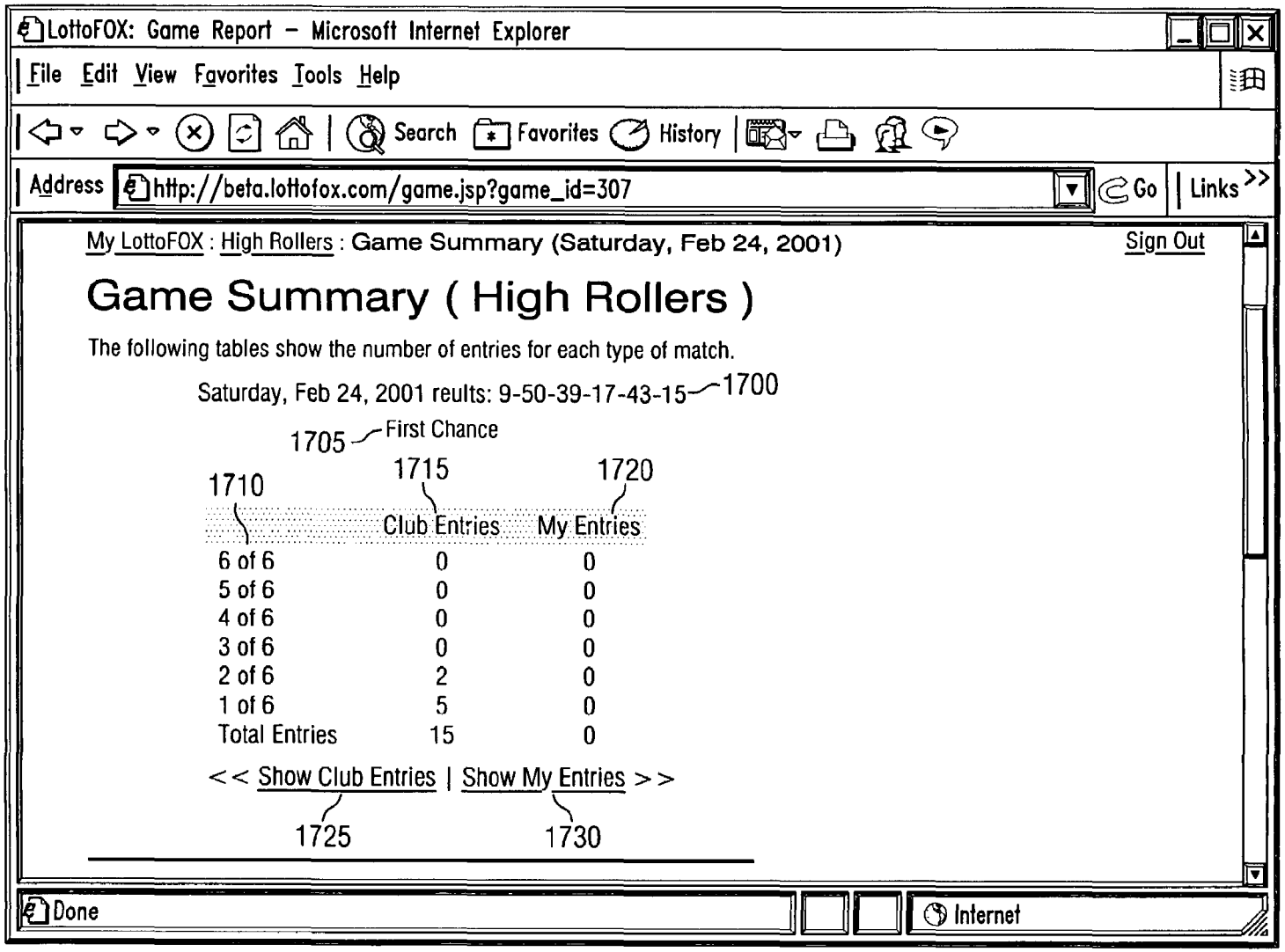
FIG. 17 is a screen shot of a summary page of the present invention.

If the participant selects the summary link 1665, then a summary screen will be displayed for the participant as in FIG. 17. The summary screen will display the date of the drawing and the numbers of the drawing 1700. The system will also display whether the summary if for a first chance drawing or a second chance drawing 1705. The system will then display the potential outcomes of the lottery drawing descending from the best outcome to the worst outcome and then the total entries in the pool 1710. The system will also display the pool entries 1715 and the number of pool entries falling into the various categories 1710. Additionally, the system will display the participant's entries 1720 and the number of those entries that fall within the various categories 1710. The participant can then select to have a detailed summary of the pool entries by selecting the show club entries link 1705 or can choose to have a detailed list of the participant's entries by selecting the show my entries link 1730.

Once the participant has selected the show club entries link 1725 or the show my entries link 1730, the system will display a detailed report as in FIG. 18. The detailed report may include the date of the lottery 1800, the results of the lottery 1805, and a detailed comparison of the results with the numbers in the lottery pool. The detailed comparison will include the pool participants' names 1810, the numbers associated with each participant 1815, and the number of matches 1820. The participant may then select to have a summary displayed by selecting the summary link 1825 or have a participant's entries displayed by selecting my entries link 1830. Additionally, the participant may select to have a participant's second chance entries displayed by selecting the display my second chance entries link 1835.

Figure 19:
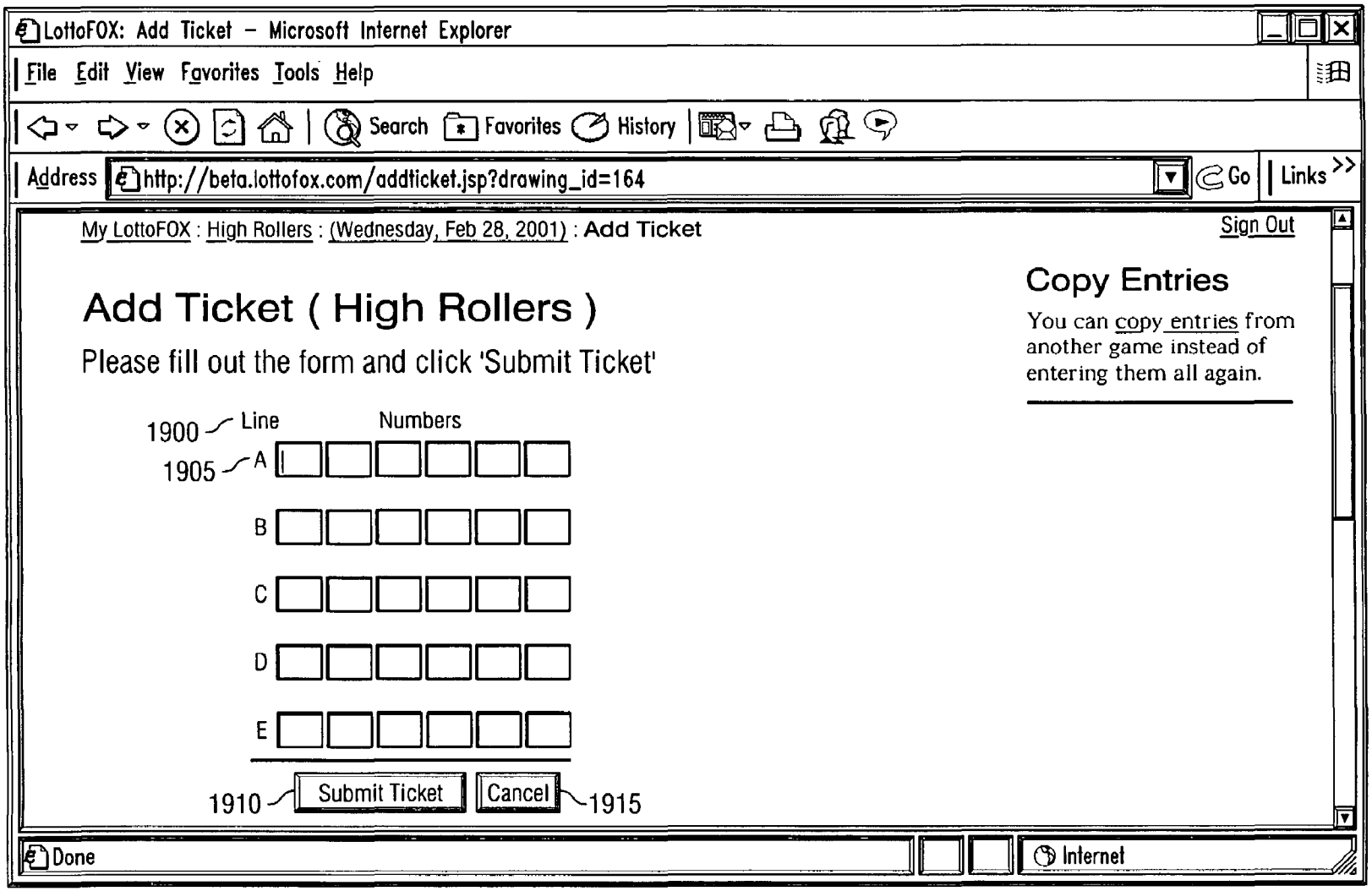
FIG. 19 is a screen shot of an add ticket page of the present invention.

If the participant selects the add ticket link 1660, the add ticket screen is displayed for the participant as in FIG. 19. The add ticket screen will show an add ticket form 1900. The add ticket form 1900 will have one or more slots to add ticket numbers to the pool 1905. Once the participant has added the ticket numbers at 1905, the participant may either submit the ticket numbers to the system by selecting the submit ticket button 1910 or cancel the ticket number addition by selecting the cancel ticket addition button 1915.

Figure 20:
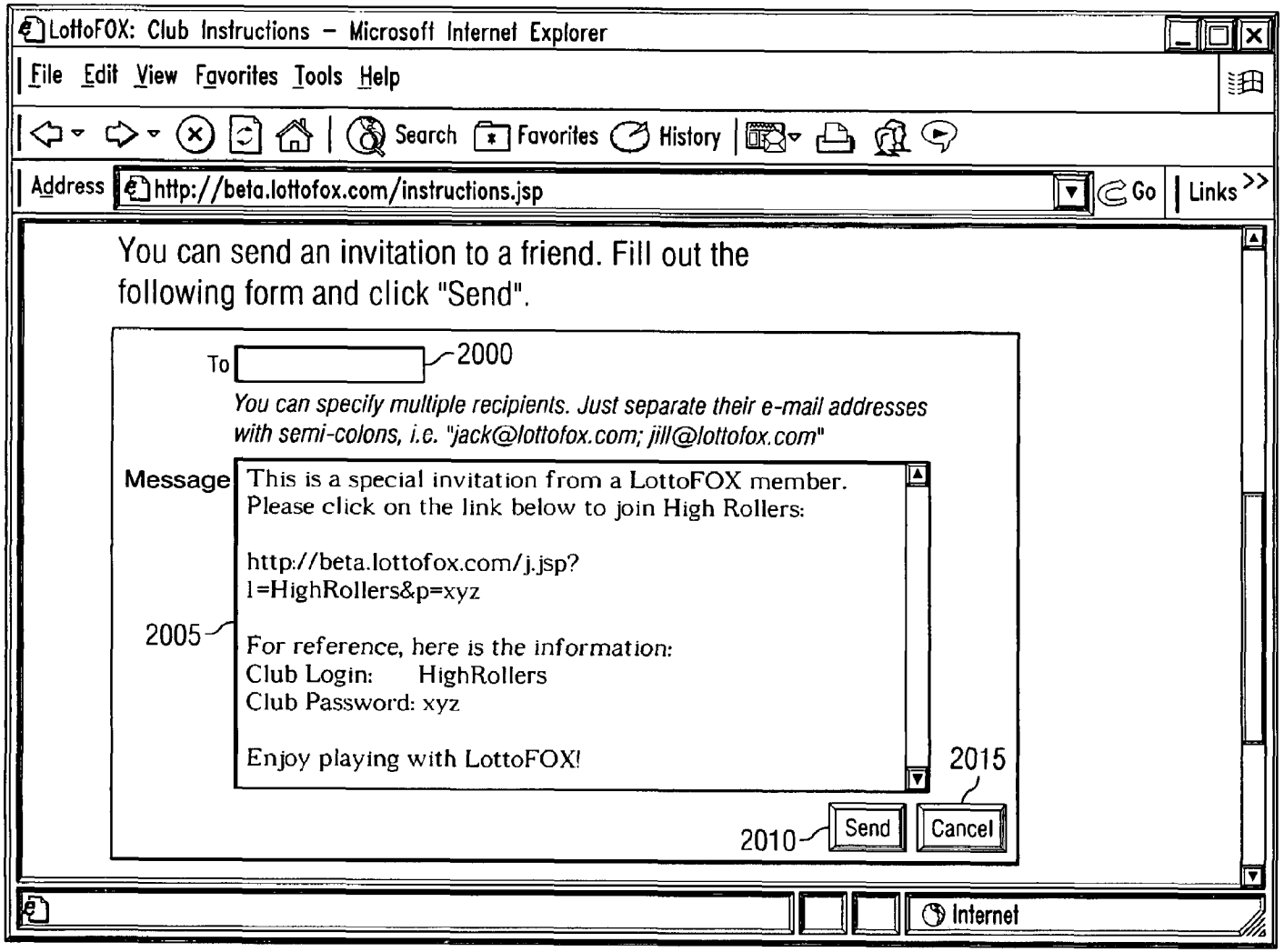
FIG. 20 is a screen shot of an invite a friend page of the present invention.

If the participant selects the invite a friend link 1675, the system will display an invite friend screen as in FIG. 20. The invite friends screen displays an electronic mail window. The electronic mail window allows the participant to enter an e-mail address for a friend in slot 2000 and compose a message to send to the friend as in 2005. Once the participant has selected a friend and composed the message, the participant may send the message by selecting the send button 2010 or cancel the message by selecting the cancel button 2015. It will be appreciated that although this example displays an electronic mail screen, other types of messaging systems may be employed with the lottery pooling management system.

Within a personalized account a participant has the ability to customize the environment. For example, a participant can set up automatic notification (e.g., email reminders), which are sent out when the jackpot reaches a certain amount, and can choose from several notification options, which will automatically inform the participant of results after selected/relevant drawings are reported. The participant can form a "favorite list" of numbers that are played regularly, or use the random number generator to make a pick.

The creator of a pool has certain "Pool Master" privileges, which help to manage the pool. A participant can be a member of more than one pool (e.g., a participant may play with the group at the office, and also with softball team). The system can also develop a profile for the participant. Profile information is useful for providing tailored information to the participant and/or for advertising purposes.

Online lottery ticket sales can be provided as an aspect of the present invention. This service is not yet available due to government constraint. Payment methods currently available on e-commerce enabled Internet sites may be incorporated into the present invention for purposes of buying/selling lottery tickets. Once tickets are bought, the system may automate the entry of tickets into pools established by the participant/buyers.

Most transactions over the Internet today are conducted using credit cards. They are commonly known among consumer as a regular way to conduct business, so there is high penetration in the marketplace. What hinders credit card usage over the Internet is the high transaction cost involved. Although the consumer is usually unaware of these costs, e-commerce businesses are highly aware of the added costs. Further, credit cards are the least secure of all types of transaction processing over the Internet. As they are also the most widely used, it follows that consumers are highly skeptical as to the safety of Internet transactions.

Smart cards have not yet established high popularity within the U.S., although they are very widely used throughout Europe. According to Dataquest of San Jose, Calif., 90% of worldwide smart card shipments went to Europe in 1995, and only 2% of all smart cards were shipped to the Americas. However, by 2001, the Americas will account for 20% of smart cards shipments, Asia 25% and Europe 40% of all smart card shipments. The main component of this type of card is the card reader, which is a device that hooks into a personal computer. When the consumer wants to perform a transaction, the card is swiped through the reader and information is transmitted directly to the on-line vendor. Java-enabled smart cards will allow increased information to reside within the smart card, making them easier and safer to use. Further, these cards will make available to consumers the possibility of uploading more information and applications onto the java chip residing within the smart card.

American Express® is one credit card company that has realized the consumer's sensitivity with transaction processing over the Internet and has introduced its new "Blue" card to make these types of transactions. The "Blue" package begins with the "smart chip" and a reader. The smart chip stores all of the user's personal information, including card number, shipping and billing information, in a certificate of authenticity. The user also obtains a personal identification number as a means of authenticating information. The information is loaded onto the chip from the smart card reader, which is a device that simultaneously hooks up to the card and the user's computer via the serial port. The user then establishes an "on-line wallet," which automatically fills out and sends Internet information forms using billing, card and shipping information stored on the smart chip.

Digital cash is also known as "e-money" or "e-cash." This form of money is issued with a bank, and all transactions are processed through a bank rather than a business. In order for consumers to use this type of money they must first set up this type of account with a participating bank. When the account is set up, the user deposits a certain amount of money that will be used for Internet transactions. When the user wants to purchase something using this e-cash account, they tell the bank by sending an encrypted message. The bank then debits the customer's account for the amount requested and the customer can use this money at Internet retailers that accept e-cash. Although this method is highly secure and dependable as a means of exchange over in the Internet, its success is hindered by limited market penetration, slow consumer acceptance, and competing standards from different vendors.

For consumers not using credit card or e-cash in any way, the conventional method of using the telephone is always an option. Fax transmittal is also popular, especially among Internet casinos. However, some form of "e-credit" will most likely remain the most popular medium of exchange for e-commerce due to its widespread use.

One additional potential alternative for processing transactions in the on-line lottery world, would be the use of a direct demand account (DDA), which allows a single master account to be managed by a lottery operator/sponsor. This type of process would provide much lower transaction costs, more efficient and reliable operations, and in the case of government-sponsored lotteries, a higher degree of security and brand awareness.

It will become apparent to one skilled in the art that various modifications to embodiments of the invention as described herein can be made without departing from the spirit or scope of the invention described and/or as further defined by the following claims.

What is claimed is:

1. A lottery pool management system implemented on a management server computer system for lottery pool management over a communications network connected to said management server computer system, said lottery pool management system comprising:

a participant interface resident on said management server computer system and configured to be in communication with plural participant computers, said participant interface also being configured to enable each of a plurality of pool participants to participate together in one or more lottery pools, each lottery pool being associated with a lottery and having a plurality of sets of numbers entered in its associated lottery, said participant interface enabling said pool participants to exchange information regarding each of said lotteries prior to the drawing thereof;

said participant interface being further configured to enable each of said pool participants to be informed by way of said participant computers, respectively, of all of said sets of lottery numbers that are entered by respective pool participants in each of said lotteries prior to the drawing thereof;

a lottery interface resident on said management server computer system and in communication with each of said lotteries and said participant interface, said lottery interface being configured to ascertain drawing results and jackpot amounts for each of said lotteries, to compare the drawing results with the said sets of lottery numbers entered in the one or more lottery pools, and to recognize that a winning event has occurred when a given one of said sets of lottery numbers is drawn as a winning set for its corresponding lottery; and a notification interface resident on said management server computer system and in communication with said participant interface and said lottery interface, said notification interface being configured to alert said pool participants by way of said participant computers, respectively, about activity in each of said lotteries, about the compared drawing results, and, when one of said winning events occurs, to notify each of said pool participants that they are each entitled to share in all amounts that are to be paid out as the result of said given set of lottery numbers being drawn as a winning set.

2. The lottery pool management system of claim 1 wherein said participant interface includes a lottery pool creation module to allow pool participants to respectively create new lottery pools by way of one or more participant computers.

3. The lottery pool management system of claim 1 wherein said participant interface includes a ticket entry module to allow pool participants to enter tickets numbers into the lottery pools associated with said pool participants, and to change ticket numbers that were entered previously.

4. The lottery pool management system of claim 1 wherein said pool participants are each members of a club disposed to participate in a number of successive lotteries, and wherein said participant interface includes a participant history module to allow pool participants to track the history of numbers chosen and played by said pool participants in one or more previous lotteries; and said notification interface is configured to notify each of said club members when a lottery reaches a specified jackpot level.

5. The lottery pool management system of claim 1 wherein the participant interface includes a second chance module to allow pool participants to replay numbers.

6. The lottery pool management system of claim 1 wherein the lottery interface is further configured to retrieve rules and regulations associated with the one or more lotteries.

7. The lottery pool management system of claim 1 wherein the lottery interface includes a ticket purchasing module to allow the system to purchase tickets for the one or more lotteries at the request of pool participants.

8. The lottery pool management system of claim 1 wherein the activity in the one or more lotteries is a completed drawing.

9. The lottery pool management system of claim 1 wherein the activity in the one or more lotteries is an updated jackpot amount.

10. The lottery pool management system of claim 1 further including one or more databases.

11. The lottery pool management system of claim 10 wherein the one or more databases contain information concerning the one or more sets of lottery numbers.

12. The lottery pool management system of claim 10 wherein the one or more databases contain information concerning the one or more lottery pools.

13. The lottery pool management system of claim 10 wherein the one or more databases contain information concerning the pool participants.

14. The lottery pool management system of claim 10 wherein the one or more databases contain information concerning the one or more lotteries.

15. A system for lottery pool management over a global communications network comprising:

one or more participant computers;

one or more lottery pool management servers, the one or more lottery pool management servers being in communication with the one or more participant computers through the global communications network; and a lottery pool management system resident on the one or more lottery pool management servers, wherein the lottery pool management system includes:

a participant interface, the participant interface being in communication with a participant computer, the participant interface being configured to enable each of a plurality of pool participants to participate as members of a group having a common interest in one or more different lottery pools, wherein each lottery pool is associated with a different lottery and each lottery pool has a plurality of sets of lottery numbers respectively provided by one or more of said pool participants;

a lottery interface, the lottery interface being in communication with one or more lotteries and the participant interface, the lottery interface being configured to ascertain drawing results and jackpot amounts for the one or more lotteries, to compare the drawing results with the sets of lottery numbers in the one or more lottery pools, and to recognize that a winning event has occurred when a given one of said sets of lottery numbers is drawn as a winning set for its corresponding lottery; and a notification interface, the notification interface being in communication with the participant interface and the lottery interface, the notification interface being configured to alert said plurality of pool participants about activity in the one or more lotteries, about the compared drawing results, and, when one of said winning events occurs, to notify each of said plurality of pool participants that they are each entitled to share in all amounts that are to be paid out as the result of said given set of lottery numbers being drawn as a winning set.

16. The system of claim 15 wherein the participant interface includes a lottery pool creation module to allow pool participants to respectively create new lottery pools.

17. A lottery pooling management system configured for operation on an electronic communications network, said system comprising:

a participant interface, the participant interface being in communication with a participant computer, the participant interface being configured to increase the chances for each of a plurality of pool participants to win a lottery by enabling each of said plurality of pool participants to participate as members of a group having a common interest in one or more lottery pools, wherein each lottery is limited to a single elective participation event, at least one lottery pool comprising different sets of lottery numbers respectively provided by one participant or by different participants, selectively;

a lottery interface, the lottery interface being in communication with one or more lotteries and the participant interface, the lottery interface being configured to ascertain drawing results and jackpot amounts for the one or more lotteries to compare the drawing results with the one or more sets of lottery numbers in the one or more lottery pools, and to recognize that a winning event has occurred when a given one of said sets of lottery numbers is drawn as a winning set for the single elective participation event of its corresponding lottery;

a notification interface, the notification interface being in communication with the participant interface and the lottery interface, the notification interface being configured to alert said plurality of pool participants about activity in the one or more lotteries, about the compared drawing results, and, when one of said winning events occurs, to notify each of said plurality of pool participants that they are each entitled to share a jackpot amount resulting from said given set of lottery numbers being a winning set; and said interfaces being resident on a lottery pool management computer connected to one or more participant computers by way of said network.

18. The system of claim 17 wherein the participant interface includes a lottery pool creation module to allow pool participants to respectively create new lottery pools.

19. The system of claim 17 wherein the participant interface includes a ticket entry module to allow pool participants to enter tickets numbers into the lottery pools associated with the pool participants and to edit the ticket entries.

20. The system of claim 17 wherein the participant interface includes a participant history module to allow pool participants to track the history of numbers chosen and played by the pool participants.

21. The system of claim 17 wherein said lottery interface includes a comparison module operable to compare the drawing results for first time winners and for second chance winners among said participants.

22. The system of claim 17 wherein said lottery interface includes a ticket purchase module operable to enable said lottery interface to purchase tickets through said communications network for said pool participants by way of one of direct purchase by said pool participants and purchases coordinated by said lottery interface.

23. The system of claim 17 including a module for displaying on a participant computer a report showing at least one of the number of entries of sets of numbers by participants and the number of matches of winning numbers entered by respective participants.

* * * * *